US006466752B2

(12) United States Patent
Tsunoda

(10) Patent No.: US 6,466,752 B2
(45) Date of Patent: Oct. 15, 2002

(54) METHOD OF IMPROVING SOUND QUALITY AND IMAGE FORMATION APPARATUS

(75) Inventor: Koichi Tsunoda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/977,367

(22) Filed: Oct. 16, 2001

(65) Prior Publication Data

US 2002/0090224 A1 Jul. 11, 2002

(30) Foreign Application Priority Data

Oct. 16, 2000 (JP) ..... 2000-315003
Sep. 21, 2001 (JP) ..... 2001-289084

(51) Int. Cl.[7] ..... G03G 21/20

(52) U.S. Cl. ..... 399/91; 381/71.1; 381/73.1; 399/1; 399/411

(58) Field of Search ..... 38/71.1, 71.14, 38/73.1; 399/1, 91, 411

(56) References Cited

U.S. PATENT DOCUMENTS 4,954,849 A 9/1990 Koike et al.
4,975,749 A 12/1990 Tsunoda et al.
4,979,727 A 12/1990 Koike et al.
5,014,091 A 5/1991 Koike et al.
5,930,557 A * 7/1999 Sasahara et al. ..... 399/91
6,006,054 A * 12/1999 Wong et al. ..... 399/91

FOREIGN PATENT DOCUMENTS

| | | |
|---|---|---|
| JP | 5-132241 | 5/1993 |
| JP | 8-149746 | 6/1996 |
| JP | 9-193506 | 7/1997 |
| JP | 10-232163 | 9/1998 |
| JP | 10-253440 | 9/1998 |
| JP | 10-253442 | 9/1998 |
| JP | 10-267742 | 10/1998 |
| JP | 10-267743 | 10/1998 |

* cited by examiner

*Primary Examiner*—Hoang Ngo
(74) *Attorney, Agent, or Firm*—Oblon, Spivak, McClelland, Maier & Neustadt, P.C.

(57) ABSTRACT

A method of improving the quality of sounds produced from a device provided with a mechanical drive mechanism and the like is provided. In this method, by using either one of or both of units for suppressing noise of a noise source produced in said device and of its transmission path, a discomfort index S of a sound obtained by inputting a value of loudness and a value of sharpness of psychological sound parameters obtained from a sound at a position apart by 1 meter from the exterior of said device into the following equation (a):

$$S=0.01024269\times(\text{loudness value})^2+0.30996744\times(\text{sharpness value})-2.1386517 \quad \text{(a)}$$

will satisfy the following condition (b):

$$S<-0.3555 \quad \text{(b)}$$

13 Claims, 19 Drawing Sheets

METHOD OF IMPROVING SOUND QUALITY AND IMAGE FORMATION APPARATUS

FIELD OF THE INVENTION

The present invention relates to a method of improving sound quality for performing improvement against bad influence due to uncomfortable sounds such as a motor driving sound during operation, an impulsive sound due to operation of a clutch or a solenoid, or a sound produced during paper conveyance, and also to an image formation apparatus using the same.

BACKGROUND OF THE INVENTION

In recent years, there has been a growing interest in a noise problem from a viewpoint of being friendly to the environment. The office environment has also the same noise problem. Accordingly, there are many requests to solve the noise problem in OA equipment used in offices. Therefore, silencing of OA equipment has been progressing and a quite higher level of silencing can be achieved as compared to the conventional technology.

As a concrete example of silencing, there is one that generates a masking sound corresponding to a frequency band of noise so as to make the noise unobtrusive as described in Japanese Patent Application Laid-Open No. 09-193506. In this example, a sound is not eliminated by eliminating a noise source itself but by adding a masking sound to the sound. Therefore, a noise level sometimes increase, which may be heard obtrusive. Further, a masking sound generating mechanism is required, which may cause a device to be upsized.

Some examples of focusing on sound quality and evaluating it are proposed (e.g., Japanese Patent Application Laid-Open (JPA) No. 10-232163, JPA No. 10-253440, JPA No. 10-253442, JPA No. 10-267742, and JPA No. 10-267743).

A sound power level (ISO 7779) is generally used as a method of evaluating noise in the OA equipment.

However, since the sound power level is a value of sound energy produced from office equipment such as a copier or a printer, a correlation between the value and a subjective uncomfortable feeling of a human against noise may not be obtained accurately. For example, when you listen to sounds having the same sound power level by comparing one to another, you may find that there is a difference in discomfort between the sounds. Some of the sounds having a small value of the sound power level is sometimes very annoying. Therefore, in order to improve the office environment in the future, it is required to not only evaluate sounds of the OA equipment based on the sound power levels and reduce them but also evaluate and improve their sound quality. In order to evaluate and improve sound quality, it is necessary to perform quantitative measurement of sound quality to ascertain the present situation and measure how much the sound quality is improved after improvement is applied as compared to the sound quality before the improvement.

In general, the sound quality is not a physical quantity, so that quantitative measurement cannot be performed. Accordingly, it is also difficult to set a target value in the current situation.

When the sound quality is evaluated by a human, only qualitative expressions are given such as "sound quality has been improved a little" or "it has been improved quite a lot". Further, there is an individual difference. Therefore, evaluation may be different depending on individuals, or it may be difficult to determine whether an obtained result can be generalized.

In order to learn whether measures actually taken for evaluation of sound quality have been truly effective or how much the measures have been effective, the quality of the sound has to be expressed quantitatively based on physical characteristics. If not, it is impossible to objectively evaluate the sound quality.

There are psychological sound parameters as physical quantities used for evaluation of sound quality. Typical ones are as follows (inside the parentheses: units). (See, e.g., "Design and System's Conference '97: With the aim of innovative jump of design and system toward the 21 century" Japanese Society of Mechanical Engineers, Nov. 10, 11, 1997, Paper No. 089B on Session "Sound, Vibration and Design, Color and Design (1)")

Loudness (sone)

Sharpness (acum): Relative distribution of high frequency components

Tonality (tu): Articulatory property, content of a pure sound component

Roughness (asper): Feeling of sound roughness

Fluctuation strength (vacil): A sort of whine

In addition to these parameters, equipment capable of measuring a psychological sound parameter such as Impulsiveness (iu) has appeared on the market.

The uncomfortable feeling will increase as the values of the parameters increase. Of the parameters, only the loudness is standardized in ISO 532B. With regard to the other parameters, programs and calculating methods are different depending on specific studies by makers of measuring instrument although their basic ideas are the same. Therefore, naturally, measured values are slightly different depending on the makers.

By expending efforts to reduce all of these psychological sound parameters, the sound quality will certainly be improved.

However, taking measures against all the parameters requires enormous efforts.

Noise produced from the OA equipment such as a copier or a printer includes noise with various types of tones due to complexity of its mechanism. For example, oppressive sounds of low frequencies, high-pitched sounds of high frequencies, or impulsively produced sounds are produced from a plurality of sound sources such as the motor, paper and solenoid while changing over time. A human analyzes totally these sounds to determine whether they are uncomfortable sounds, and, during this time, it is considered that the determination is given by applying a weight to any part that is particularly related to discomfort. That is, there are some of psychological sound parameters that may largely affect discomfort and some that may not much affect discomfort. These sound types are different depending on tones of machines. For example, in a printer that operates at a high speed and produces a large number of impulsive sounds, the impulsive sounds are felt the most uncomfortable. While, in a desktop printer that operates at a low speed and comparatively quietly, charging sounds during AC charging are felt the most uncomfortable because the impulsive sounds are not much produced. The sound sources that make us feel uncomfortable are different as explained in the above cases. Therefore, the sound sources whose sound quality is to be improved may be different in a low-speed machine and a high-speed machine. Based on this fact, less efforts will be expended by finding out a sound source to be largely effective in improvement against discomfort and its psychological sound parameters, and efficiently improving its sound quality through reduction in values of the psychological sound parameters by means of countermeasures against the uncomfortable sound source and countermeasures against its transmission path.

As a result, it becomes possible to objectively evaluate the sound quality by combining psychological sound parameters largely effective in improvement against discomfort, applying each weight to the parameters, expressing them by an evaluating equation for sound quality, and calculating subjective evaluation values for discomfort. Thus, the sound quality can be improved. Further, it is determined which values of the subjective evaluation values for discomfort are to be set so that the discomfort will disappear. By providing an apparatus whose sound quality has been improved so as to be less than the values, the problem on noise within offices will be solved.

SUMMARY OF THE INVENTION

It is an object of this invention to enable reduction of uncomfortable sounds by improving their sound quality. More specifically, it is an object of this invention to provide a sound quality improving method capable of loosening a psychological uncomfortable feeling.

Another object of this invention is to provide a sound quality improving method capable of more effectively loosening a psychological uncomfortable feeling.

A further object of this invention is to provide a sound quality improving method capable of loosening an uncomfortable feeling by reducing a sound produced during paper conveyance in an image forming device.

A still further object of this invention is to provide a sound quality improving method capable of loosening an uncomfortable feeling by reducing an impulsive sound due to metal in an image forming device.

A still further object of this invention is to provide a sound quality improving method capable of loosening an uncomfortable feeling by reducing noise produced from a drive system of a paper feeding unit in an image forming device.

In order to solve the problem on such uncomfortable sounds, a still further object of this invention is to provide an image formation apparatus capable of loosening a psychological uncomfortable feeling by improving a source of uncomfortable sound produced during operation at a comparatively higher speed.

A still further object of this invention is to provide an image formation apparatus capable of loosening a psychological uncomfortable feeling by selectively combining uncomfortable sound sources so as to reduce the sounds.

A still further object of this invention is to provide an image formation apparatus capable of loosening a psychological uncomfortable feeling by specifying calculation of psychological sound parameters by a limited condition.

One aspect of this invention is the method of improving the quality of sounds produced from a device provided with a mechanical drive mechanism and the like. By using either one of or both of units for suppressing noise of a noise source produced in the device and of its transmission path, a discomfort index S of a sound obtained by inputting a value of loudness and a value of sharpness of psychological sound parameters obtained from a sound at a position apart by 1 meter from the exterior of the device into the following equation (a):

$$S=0.01024269\times(\text{loudness value})^2+0.30996744\times(\text{sharpness value})-2.1386517 \quad (a)$$

will satisfy the following condition (b):

$$S<-0.3555 \quad (b)$$

Further, the obtained discomfort index S further satisfies the following condition (c):

$$S<-0.6296 \quad (c)$$

Another aspect of this invention is the image formation apparatus to which the sound quality improving method according to the invention is applied. The mechanical drive mechanism includes a paper conveying unit and a drive transmitting unit, and a sound produced from the paper conveying unit is reduced to satisfy the condition (b) or (c).

Further, the image formation apparatus uses a unit that reduces a sliding sound produced between paper and a guiding member for the paper as the sound produced from the paper conveying unit.

Further, in the image formation apparatus, the paper conveying unit has a guiding unit for paper, which is formed with a flexible sheet, and an edge part of its surface contacting the paper is bent.

Further, in the image formation apparatus, a metal-impulsive sound is reduced to satisfy the condition (b) or (c).

Further, the image formation apparatus further comprises paper conveying units in a plurality of stages which become a source where the metal-impulsive sound is produced. The paper conveying units have electromagnetic clutches for the number of stages, and, of the electromagnetic clutches, only an electromagnetic clutch of the paper conveying unit in a state of being ready to convey paper is operated.

Further, in the image formation apparatus, a sound produced from a drive system of the paper conveying unit is reduced to satisfy the condition (b) or (c).

Further, in the image formation apparatus, air-borne sound is insulated from the drive system.

Further, in the image formation apparatus, the mechanical drive mechanism has a developing unit, and a sound from the developing unit is reduced to satisfy the condition (b) or (c).

Further, in the image formation apparatus, the developing unit has a developing member and a developing member driving unit that drives the developing member. The developing member driving unit has a drive transmitting unit for transmitting a drive force to the developing member, and a reference with respect to positioning for transmitting a driving force between the developing member driving unit and the developing member and a reference with respect to positioning for mounting both of the unit and member are made coincide with each other.

Further, the image formation apparatus satisfies the condition (b) or (c) by using either one of or both of suppressing units. One of the units absorbs noise from a noise source itself to suppress the noise by selectively combining noises produced from sound sources inside the apparatus, and the other one is disposed on the transmission path of the noise.

Further, in the image formation apparatus, the loudness value and sharpness value are obtained by collecting sounds produced from the image formation apparatus with a sound measuring device HSMIII manufactured by Head Acoustics and analyzing the sounds with a Binaural Analysis System BAS manufactured by Head Acoustics, and the discomfort index S satisfies the condition (b):

$$S<-0.3555 \quad (b)$$

or the condition (c):

$$S<-0.6296 \quad (c)$$

Other objects and features of this invention will become understood from the following description with reference to the accompanying drawings.

BRIEF DESCRIPTION OF THE DRAWINGS

FIG. 11A is its plan view and FIG. 11B is its side view;

DESCRIPTION OF THE PREFERRED EMBODIMENT

A preferred embodiment of this invention will be explained below with reference to the drawings.

Figure 1:
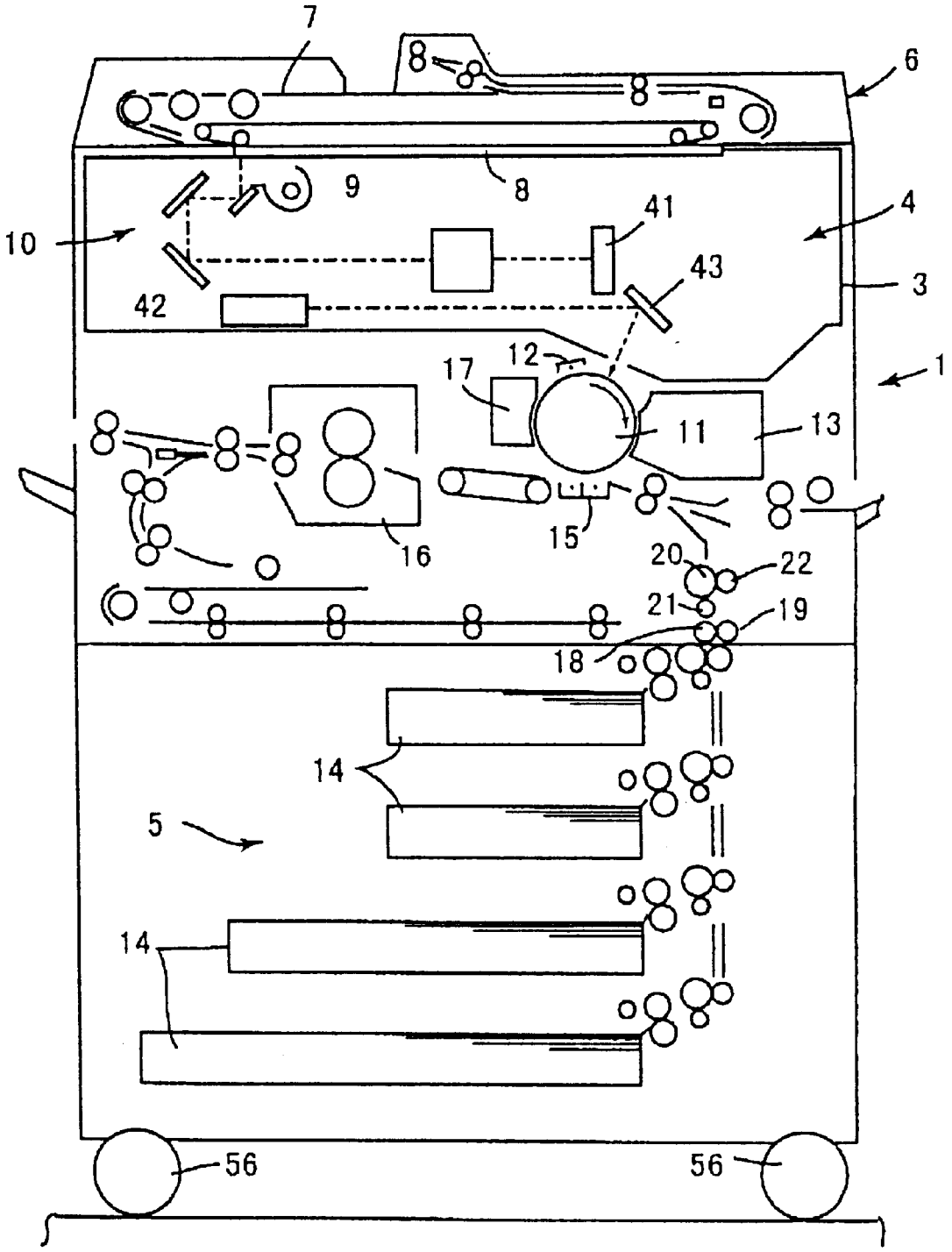
FIG. 1 shows an example of the image formation apparatus to which the sound quality improving method according to an embodiment of this invention is applied.

FIG. 1 shows an outline of a copier as an example of the image formation apparatus to which the sound quality improving method according to the embodiment of this invention is applied.

In this figure, the overall structure and the outline of functions of the copier will be explained as follows.

The copier shown in FIG. 1 is generally referred to as a console type copier, whose whole height is set to be high so that the copier can be placed on the floor for use, and the whole of which is formed with an upper housing 1 and a lower housing 2. The upper housing 1 has an optical unit 4 whose optical elements are accommodated in a case 3, and units of image forming system positioned under the optical unit 4. The lower housing 2 has a plurality of paper feeders (paper feeding bank) 5. The copier shown in FIG. 1 has an automatic document feeder (ADF) 6 mounted on the top of the upper housing 1.

An original (not shown) placed on a document base 7 of the automatic document feeder 6 is automatically fed onto a contact glass 8 supported by the case 3 of the optical unit 4 and stopped. Subsequently, a light source 9 of the optical unit 4 moves from the position shown in FIG. 1 to the right hand side. During this movement, the light source 9 illuminates the surface of the original, and an image formation optical system 10 forms an image on the original surface on a CCD 41.

The original image formed on the CCD 41 is subjected to optoelectronic conversion in the CCD 41 to become an analog electric signal. This analog electric signal is converted to a digital electric signal by an A/D converter for converting an analog value to a digital value. The digital electric signal is subjected to image processing in a control section explained later and sent to a writing unit 42. The writing unit 42 emits a light beambased on the digital signal to be irradiated onto a photoreceptor 11 through a mirror 43.

The photoreceptor 11 rotates in the clockwise direction of FIG. 1. During this rotation, its surface is uniformly charged by an electrification charger 12, and the original image is formed on the charged surface as explained above. An electrostatic latent image is formed on the photoreceptor 11 through this operation, and this latent image is visualized by a developing unit 13 as a toner image.

A paper 14 is fed from any of the paper feeders (paper feeding bank) 5 disposed in the lower housing 2 toward the photoreceptor 11, and the toner image on the photoreceptor 11 is transferred to the paper 14 by a transfer charger 15. In order to reduce a time for making a first copying as short as possible, a mode as follows is also available. In this mode, the paper separated in the paper feeder 5 is conveyed at a high speed to the photoreceptor 11 through high-speed rotation of a conveying motor (not shown). This paper passes through a fixing unit 16, where the transferred toner image is fixed on the paper, and the paper is ejected outside the machine as a copied paper.

The toner remaining on the photoreceptor 11 after the toner image has been transferred to the paper is removed by a cleaning unit 17. In this copier, an operation (two-sided copy mode) to form copies on both sides of paper is available. In this two-sided copy mode, the paper, where a copy has been formed on its surface (first surface) and its fixing has been finished, passes through a switching claw 18 and a paper conveying path 19 to be placed on an intermediate tray 20, and is on standby for next paper feeding.

When a copy is to be formed on a rear surface (second surface) of the paper, paper feeding rollers 21 of the intermediate tray 20 start operation at a timing of feeding a paper, and the paper on the intermediate tray 20 is switched back to be fed again. The paper then passes through a paper re-feeding path 22 to be conveyed to a conveying part that guides both of paper conveyed from a paper feed tray and paper conveyed from the intermediate tray for two-sided copying in a direction of resist rollers, where the copying operation is performed.

When a level of discomfort of a machine sound in a mechanical drive section or the like provided in the image formation apparatus such as the copier is to be objectively evaluated, a scale to measure discomfort is required. In the same manner as a case where sound energy is measured by a sound level meter for its evaluation, when discomfort is to be evaluated, its evaluation is performed based on a value obtained by measuring a certain physical quantity of a sound and substituting a value of the quantity in the evaluating equation for sound quality.

This sound quality evaluating equation is created by performing multiple regression analysis on a sound quality evaluating equation that predicts each level of discomfort of sounds based on scores of the sounds obtained through experiments on subjective evaluation by a human (comparison of sounds) using a plurality of psychological sound parameters of the sounds used for tests. The sound quality evaluating equation is required to have statistical significance (effectiveness) of 95% or more.

Loudness, tonality, sharpness, roughness, fluctuation strength, and impulsiveness are defined in the psychological sound parameters.

Examples of evaluation tests for sound quality of uncomfortable sounds carried out by the inventors of this invention will be explained below.

The flow of the experiment is as follows.

(1) Recording of operational sounds of the image forming device by a dummy head (2) Processing of the operational sounds, preparation of a plurality of processed sounds (preparation of sample sounds)

(3) Measurement of psychological sound parameters of the prepared sample sounds (4) Experiment based on a paired comparison method using the sample sounds, which is carried out by calculating subjective evaluation values (sound scores) with respect to discomfort (5) Multiple regression analysis based on subjective evaluation values with respect to discomfort and measured values of psychological sound parameters, which is carried out by deriving a sound quality evaluating equation (creating an equation to predict scores of sounds using the psychological sound parameters)

(1-1)

Collection of Operational Sounds of the Image Forming Device

There are five different models of the image forming devices: Model A (paper conveying speed: 362 mm/s), Model B (paper conveying speed: 230 mm/s), Model C (paper conveying speed: 305 mm/s), Model D (paper conveying speed: 275 mm/s), and Model E (paper conveying speed: 230 mm/s). Operational sounds of each front surface of these five models were collected by Dummy Head HMS (Head Measurement System) III manufactured by Head Acoustics, and the collected sounds were binaurally recorded in a digital audio tape (hereinafter DAT) or a hard disk. An image forming speed of these image forming devices corresponds to about 45 sheets to 75 sheets per min.

By binaurally recording the sounds and playing them back by dedicated headphones, the sounds can be reproduced as if the human actually hears machine sounds.

Measurement Conditions (A) Recording environment: Hemi-anechoic room (standard base is used)

(B) Position of ears of the dummy head: Height: 1.2 m, Horizontal distance from the edge of the apparatus: 1 m (C) Recording mode: FF (Free Field (for the anechoic room))

(D) HP filter: 22 Hz (2-1)

Processing of the Operational Sounds, Preparation of a Plurality of Processed Sounds (Preparation of Sample Sounds)

The operational sounds of the model A were subjected to processing by Binaural Analysis System BAS manufactured by Head Acoustics or sound quality analysis software ArtemiS of the same maker. The ArtemiS is a program for making the BAS operable on Windows (trade name).

A sound processing method is executed by attenuating or enhancing a portion corresponding to the main sound source of the image forming device from the recorded operational sounds on a frequency axis or a time axis.

The sound source selected this time includes six sound sources such as metal-impulsive sound, paper-impulsive sound, paper-sliding sound, sound of the developing unit, sound of the bank unit drive system, and sound of the main motor drive system. There are sound sources due to motors other than these six sound sources. However, if any of the sources was turned off and the impression of the sound during copying was not much changed, it was determined in pre-experiment that this sound source would not need to be measured.

Three-standard sound pressure levels (sound enhanced, original, attenuated) were assigned to each of the sound sources, and nine sounds in different combinations of the sound sources levels were prepared based on an orthogonal table with nine lines.

(3-1)

Measurement of the Psychological Sound Parameters of the Prepared Sample Sounds

The higher the subjective evaluation value α, the more uncomfortable.

The result is as shown in Table 1. Note that the sample sound (5) is the original sound of the model A.

TABLE 1

| | SAMPLE SOUND | LOUDNESS (sone) | TONALITY (tu) | SHARPNESS (acum) | ROUGHNESS (asper) | FLUCTUATION STRENGTH (vacil) | IMPULSIVE -NESS (lu) | SUBJECTIVE EVALUATION VALUE α |
|---|---|---|---|---|---|---|---|---|
| 1 | SAMPLE SOUND (1) | 7.91 | 0.03 | 2.11 | 0.52 | 1.57 | 0.55 | −0.7472 |
| 2 | SAMPLE SOUND (2) | 12.41 | 0.09 | 2.36 | 1.05 | 2.02 | 0.57 | 0.3417 |
| 3 | SAMPLE SOUND (3) | 11.28 | 0.05 | 2.09 | 1.18 | 1.84 | 0.55 | −0.1778 |
| 4 | SAMPLE SOUND (4) | 12.44 | 0.07 | 2.69 | 1.29 | 1.75 | 0.55 | 0.3167 |
| 5 | SAMPLE SOUND (5) | 10.44 | 0.04 | 2.41 | 0.98 | 1.61 | 0.53 | −0.4500 |
| 6 | SAMPLE SOUND (6) | 11.76 | 0.09 | 1.86 | 0.98 | 1.87 | 0.58 | −0.2694 |
| 7 | SAMPLE SOUND (7) | 13.21 | 0.06 | 2.51 | 1.38 | 2.19 | 0.61 | 0.3972 |
| 8 | SAMPLE SOUND (8) | 12.48 | 0.05 | 2.21 | 1.49 | 2.10 | 0.62 | 0.1806 |
| 9 | SAMPLE SOUND (9) | 12.44 | 0.03 | 3.21 | 1.23 | 2.12 | 0.64 | 0.4083 |
| 10 | MODEL B | 9.76 | 0.09 | 2.61 | 0.97 | 1.35 | 0.62 | −0.4220 |
| 11 | MODEL C | 10.61 | 0.05 | 2.19 | 1.03 | 1.52 | 0.50 | −0.0976 |
| 12 | MODEL D | 9.77 | 0.08 | 2.56 | 1.05 | 1.62 | 0.52 | −0.1898 |
| 13 | MODEL E | 9.36 | 0.10 | 2.46 | 1.01 | 1.64 | 0.57 | −0.2527 |

Psychological sound parameters of the processed sounds from the model A and the sounds from the models B to E were obtained by the Binaural Analysis System BAS manufactured by Head Acoustics or the sound quality analysis software ArtemiS of the same maker.

(4-1)

Experiment Based on Scheffe's Paired Comparison Method (Its Modified Method by Ura) Using the Sample Sounds, i.e., Calculation of Subjective Evaluation Values with Respect to Discomfort Subjects who would evaluate sample sounds were collected. They compared paired sample sounds to determine which of the two was more uncomfortable. The modified method by Ura is the paired comparison method as follows.

The order of comparison is considered. Further, one subject compares all of combinations one time each.

More specifically, paired combinations were prepared from t-pieces of materials, and N subjects compared all the combinations (i, j) and (j, and i).

Accordingly, subjective evaluation values of each sample sound were obtained and were ordered. For example, when the sample sound (1) and the sample sound (2) were compared, calculation was carried out in a manner such that 1 score would be added when the sample sound (1) was felt uncomfortable and −1 score would be added when the sample sound (2) was felt uncomfortable.

The results were collected and subjected to statistic processing. As a result, a subjective evaluation value α for each sample sound was obtained.

By the way, of the psychological sound parameters, only the loudness is standardized in ISO 532B. With regard to the other parameters, programs and calculating methods are different depending on specific studies by makers of measuring instrument although their basic ideas are the same. Therefore, naturally, measured values are slightly different depending on the makers.

The experiment was carried out using the Dummy Head HMS III manufactured by Head Acoustics and the Binaural Analysis System BAS or ArtemiS manufactured by Head Acoustics.

(5-1) Multiple Regression Analysis Based on Subjective Evaluation Values for Discomfort and Measured Values of Psychological Sound Parameters The multiple regression analysis was performed with subjective evaluation values and psychological sound parameters to derive an equation to predict a subjective evaluation value by psychological sound parameters. As a result, it is found that the subjective evaluation value α could be predicted by the equation (a). The result has the statistical significance as high as 95%.

$R^2$ (contribution rate) representing precision of the equation was 0.89. This means that the loudness and sharpness contribute to discomfort of sound by 89%. The remaining 11% indicates that discomfort is felt by the other factors.

A predicted value of the subjective evaluation value α is called a discomfort index S. The value S has no unit.

Since the sounds not only of the model A but also of the different models B to E could be predicted, the evaluating equation as follows can be said to generally hold in machines of a plurality of image forming devices in which a liner velocity of the photoreceptor 11, that affects an image forming speed, is 230 to 362 mm/S.

$$S=0.01024269\times(\text{loudness value})^2+0.30996744\times(\text{sharpness value})-2.1386517 \quad (a)$$

It is found here that the discomfort due to the image forming device, in which the linear velocity of the photoreceptor was set to 230 to 362 mm/S, can be expressed by the square of the loudness and the sharpness (content of a high frequency component, particularly a frequency of 4 kHz or more).

Figure 2:
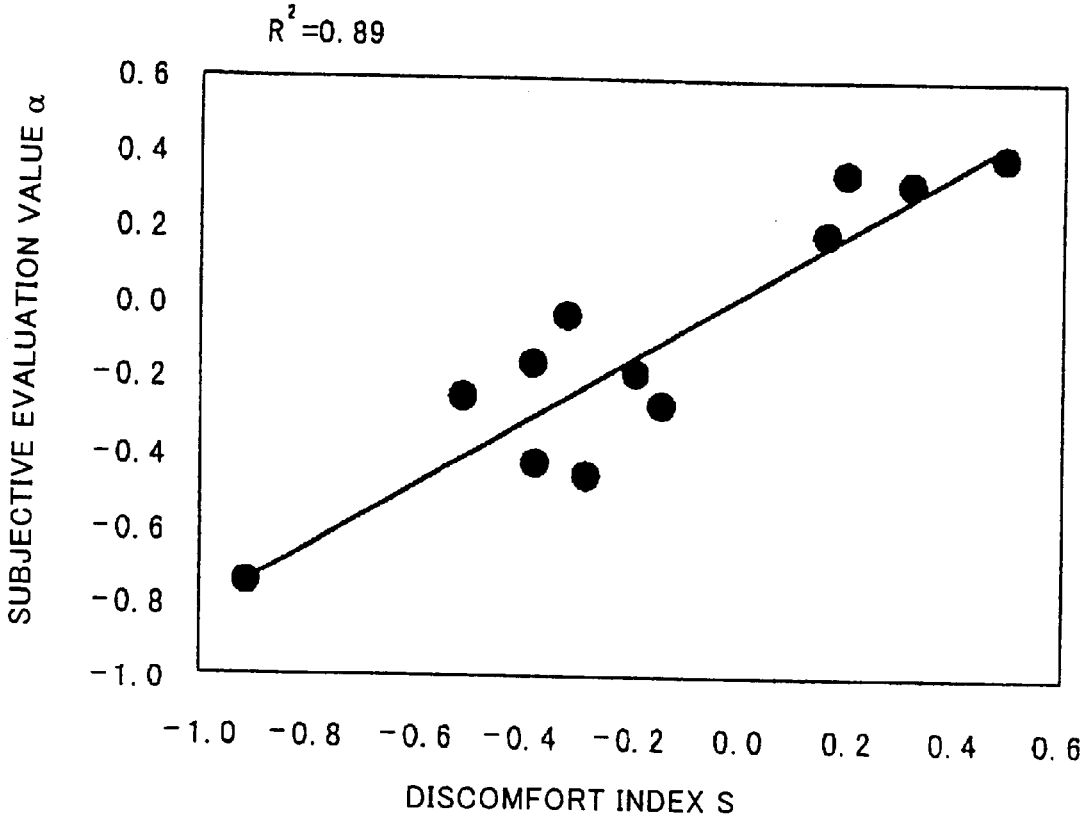
FIG. 2 is a diagram showing a relation between subjective evaluation values for an uncomfortable feeling and discomfort indexes S.

FIG. 2 shows a distribution diagram obtained by plotting the subjective evaluation values α and the discomfort indexes S (predicted values through the sound quality evaluating equation).

There is a high correlation between the subjective evaluation values α as a result of experiment based on subjective evaluation by a human and the values S. Therefore, by using the sound quality evaluating equation, objective evaluation of the uncomfortable feeling becomes possible in the feature.

Subsequently, an uncomfortable sound source was analyzed.

Table 2 represents subjective evaluation values α of the sample sounds and standard values of the processed sound sources. The standard value +1 represents the enhanced level of the sound source to such an extent that it can be clearly heard, 0 represents its original sound as it is, and −1 represents the attenuated level of the sound source to such an extent that it becomes almost impossible to be heard.

TABLE 2

| SAMPLE SOUND | SUBJECTIVE EVALUATION VALUE α | METAL-IMPULSIVE SOUND | PAPER-IMPULSIVE SOUND | PAPER-SLIDING SOUND | BANK MOTOR | DEVELOPING MOTOR | MAIN MOTOR |
|---|---|---|---|---|---|---|---|
| (1) | −0.747 | −1 | −1 | −1 | −1 | −1 | 0 |
| (2) | 0.342 | −1 | 0 | 1 | 1 | 0 | 1 |
| (3) | −0.178 | −1 | 1 | 0 | 0 | 1 | −1 |
| (4) | 0.317 | 0 | −1 | 1 | −1 | 1 | 1 |
| (5) | −0.450 | 0 | 0 | 0 | 0 | 0 | 0 |
| (6) | −0.269 | 0 | 1 | −1 | 1 | −1 | 1 |
| (7) | 0.397 | 1 | −1 | 0 | 1 | 0 | −1 |
| (8) | 0.181 | 1 | 0 | −1 | 0 | 1 | 0 |
| (9) | 0.408 | 1 | 1 | 1 | −1 | −1 | −1 |

Graphs (plots of nine sounds), created based on Table 2, each indicating a relation between the standard values of the sound sources and the subjective evaluation values α are shown in FIG. 3 to FIG. 8.

The Y axis of the graph shows the subjective evaluation values α, the highest of which indicates the most uncomfortable.

The X axis of the graph shows the horizontal standard levels of the sound sources, in which −1 indicates the attenuated sound source, 0 indicates the original sound, and +1 indicates the enhanced sound source.

Figure 3:
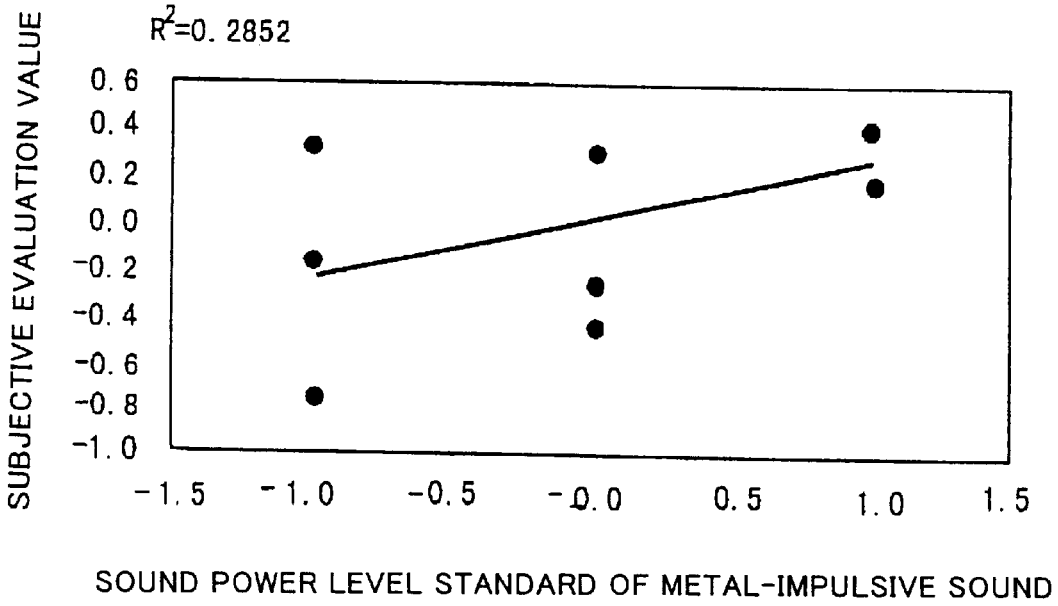
FIG. 3 is a diagram showing a relation between standard values of a sound source (metal-impulsive sound) and subjective evaluation values.
Figure 4:
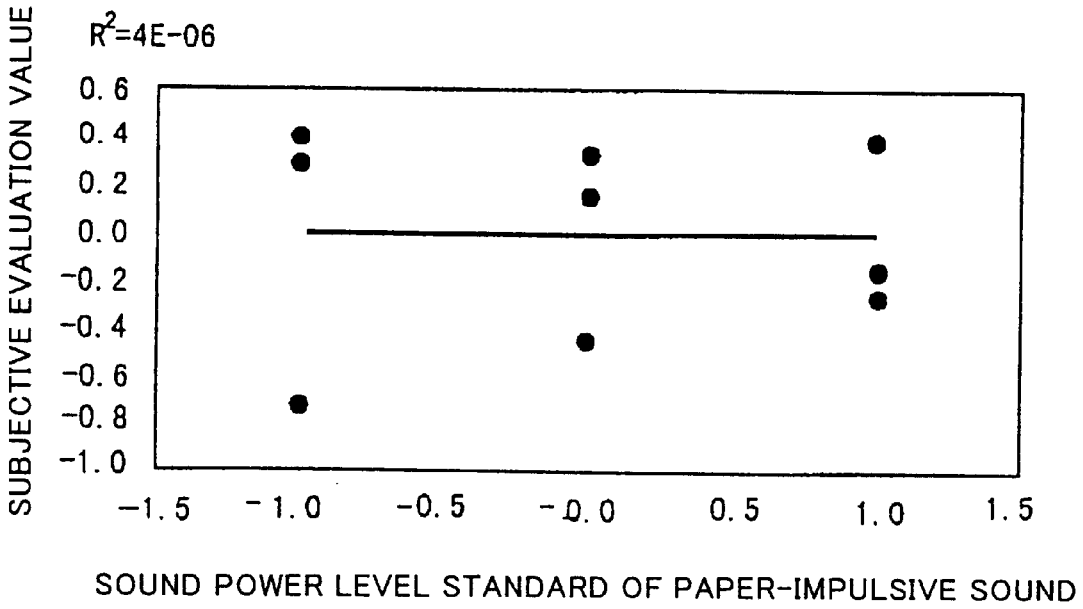
FIG. 4 is a diagram showing a relation between standard values of a sound source (impulsive sound due to paper) and subjective evaluation values.
Figure 5:
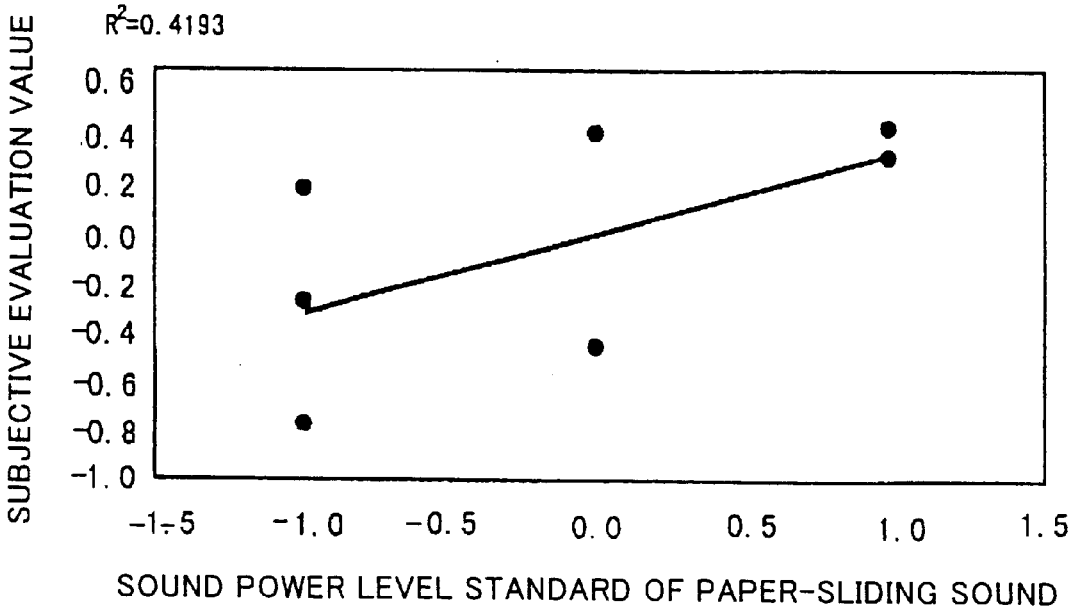
FIG. 5 is a diagram showing a relation between standard values of a sound source (sliding sound due to paper) and subjective evaluation values.
Figure 6:
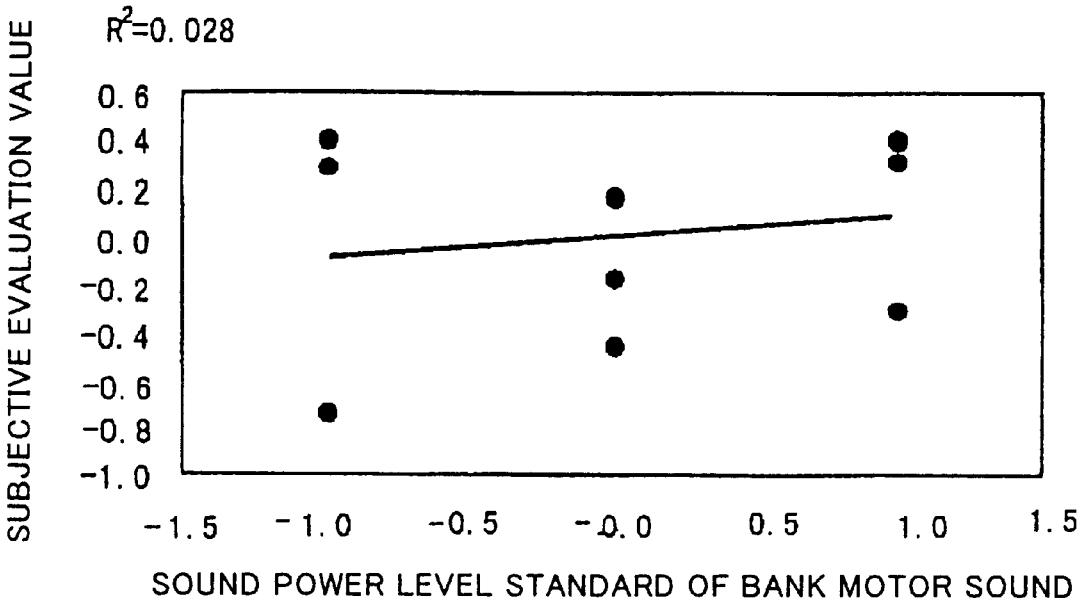
FIG. 6 is a diagram showing a relation between standard values of a sound source (bank motor) and subjective evaluation values.
Figure 7:
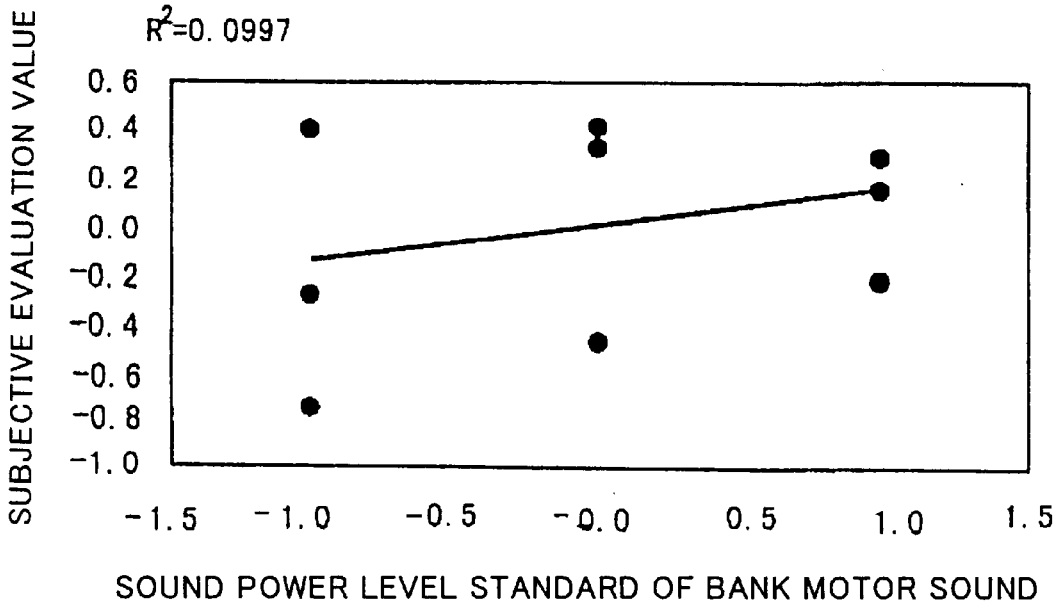
FIG. 7 is a diagram showing a relation between standard values of a sound source (developing motor) and subjective evaluation values.
Figure 8:
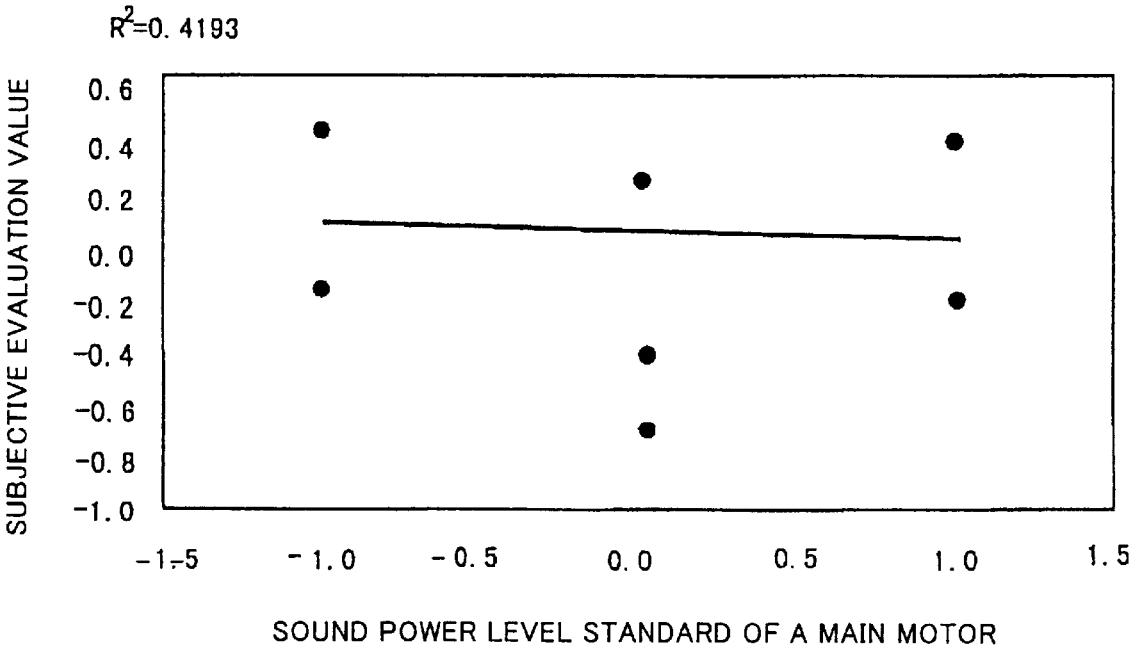
FIG. 8 is a diagram showing a relation between standard values of a sound source (main motor) and subjective evaluation values.

$R^2$ in the figures is referred to as a contribution rate, and R is a correlation coefficient. The contribution rate means by what % the sound source contributes to the discomfort. Referring to FIG. 3, the metal-impulsive sound contributes to the discomfort by about 28.5%. That is, if there is a high correlation between changes in levels of the sound source and changes in subjective evaluation values α (discomfort), the contribution rate becomes high.

Referring to the values of $R^2$ in FIG. 3 to FIG. 8, the paper-impulsive sound and the sound of the main motor drive system hardly contribute to discomfort. Thus, it is understood that there is no need to take any measures against the discomfort (there may be the need for taking any measures against the discomfort in terms of evaluation based on the sound power level).

The sound contributing to the discomfort the most is the paper-sliding sound followed by the metal-impulsive sound. The bank motor drive system and the developing motor drive system less contribute to the discomfort, but more or less contribute to it.

Table 3 provides a summary of results of carrying out the experiment on at which value of the discomfort index S the discomfort will disappear.

One of the subjects listened to 21 sounds in total of the sample sounds (1) to (10) obtained by processing the sounds of the model A and the sounds of the models B to E, and evaluated the sounds with respect to the discomfort in three stages. The sample sounds (10) to (17) are obtained by changing the level, at which each sound source of the sample sounds (1) to (9) (except (5)) used in the experiment for sound quality evaluation is enhanced or attenuated, to a certain level such that the subject can hear the sound source somehow.

Loudness values and sharpness values of these sounds were measured by the Binaural Analysis System BAS or ArtemiS manufactured by Head Acoustics. The result of measurement was substituted into the equation (a) to obtain a discomfort index S.

Each subject evaluated the sounds based on A: the high-evaluated sound, C: the low-evaluated sound, and B: the intermediate. In this table, CC indicates the sound that all the subjects evaluated as rank C, and AA indicates the sound that all the subjects evaluated as rank A.

TABLE 3

| SAMPLE SOUND | S VALUE | EVALUATION |
|---|---|---|
| (9) | 0.4402 | CC |
| (7) | 0.4268 | CC |
| (4) | 0.2790 | CC |
| (2) | 0.1703 | CC |
| (8) | 0.1417 | C |
| (17) | 0.0364 | C |
| (13) | −0.0129 | C |
| (15) | −0.0363 | C |
| (11) | −0.1134 | B |
| (6) | −0.1468 | B |
| (16) | −0.1491 | B |
| (3) | −0.1903 | B |
| (14) | −0.2433 | B |
| (12) | −0.2649 | B |
| (5) | −0.2763 | B |

TABLE 3-continued

| SAMPLE SOUND | S VALUE | EVALUATION |
|---|---|---|
| MODEL C | −0.3083 | B |
| MODEL B | −0.3555 | A |
| MODEL D | −0.3674 | A |
| MODEL E | −0.4813 | A |
| (10) | −0.6296 | AA |
| (1) | −0.8446 | AA |

Based on this result, by satisfying $$S<-0.3555 \qquad \text{condition (b)},$$

the uncomfortable feeling will be loosened. That is, by setting the loudness value and the sharpness value of the equation (a) so as to satisfy the condition (b), it is possible to obtain an image formation apparatus with the uncomfortable feeling loosened.

Further, if the values satisfy S<−0.6296 . . . condition (c), it is possible to provide an image formation apparatus with sounds that are hardly felt uncomfortable.

It was simulated how the value of a discomfort index S obtained through the sound quality evaluating equation (a) would be changed by modifying an uncomfortable sound source. Accordingly, it is possible to modify each sound source and set a target value for improvement as the overall apparatus. Table 4 indicates the results of settings.

The simulation for improvement is carried out so that a sound of a sound source is attenuated to a level at which the sound cannot be heard any more, that is, to the level the same as that at the time of preparing the sample sounds (1) to (9). In this simulation, the sounds were processed and loudness values and sharpness values were also calculated by the Binaural Analysis System BAS or ArtemiS manufactured by Head Acoustics. The discomfort index S is obtained by substituting the loudness value and sharpness value into the equation (a).

"Effect due to sound quality improved from the present situation" in Table 4 is a value of a difference between the discomfort index S (=−0.276) of "present situation" in No. 1 of Table 4 and each discomfort index S obtained after improvement.

TABLE 4

| No. | SOUND SOURCE TO BE IMPROVED | LOUDNESS (sone) | SHARPNESS (tu) | SOUND QUALITY EVALUATED VALUE FOR DISCOMFORT | EFFECT DUE TO SOUND QUALITY IMPROVED FROM THE PRESENT SITUATION |
|---|---|---|---|---|---|
| 1 | PRESENT SITUATION (SP-5 ORIGINAL SOUND) | 10.44 | 2.41 | −0.276 | |
| 2 | PAPER-SLIDING SOUND | 9.73 | 2.08 | −0.525 | 0.249 |
| 3 | METAL-IMPULSIVE SOUND | 9.50 | 2.25 | −0.518 | 0.242 |
| 4 | SOUND OF BANK MOTOR DRIVE SYSTEM | 9.86 | 2.52 | −0.364 | 0.088 |
| 5 | SOUND OF DEVELOPING MOTOR DRIVE SYSTEM | 10.12 | 2.46 | −0.330 | 0.053 |
| 6 | PAPER + METAL | 8.88 | 1.93 | −0.735 | 0.459 |
| 7 | PAPER + DEVELOPING | 9.41 | 2.12 | −0.577 | 0.301 |
| 8 | PAPER + BANK | 9.15 | 2.18 | −0.608 | 0.332 |
| 9 | METAL + DEVELOPING | 9.20 | 2.29 | −0.563 | 0.287 |
| 10 | METAL + BANK | 8.93 | 2.35 | −0.594 | 0.318 |
| 11 | DEVELOPING + BANK | 9.51 | 2.57 | −0.416 | 0.139 |
| 12 | PAPER + METAL + DEVELOPING | 8.58 | 1.96 | −0.778 | 0.502 |
| 13 | PAPER + METAL + BANK | 8.30 | 2.02 | −0.807 | 0.531 |
| 14 | PAPER + DEVELOPING + BANK | 8.80 | 2.23 | −0.657 | 0.380 |
| 15 | METAL + DEVELOPING BANK | 8.60 | 2.41 | −0.636 | 0.359 |
| 16 | PAPER + METAL + DEVELOPING + BANK (EACH SOUND SOURCE LEVEL REDUCED TO 1/2) | 9.44 | 2.31 | −0.511 | 0.235 |
| 17 | PAPER + METAL + DEVELOPING + BANK | 7.98 | 2.07 | −0.847 | 0.571 |

According to No. 2 to 5 in Table 4, when the uncomfortable sound source is singly improved, the effect due to improved sound quality is high in order of the paper-sliding sound, metal-impulsive sound, sound of the bank motor drive system, and the sound of the developing motor drive system. According to the results from No. 6 and on, it is possible to predict which combination of the sound sources is the most effective in improvement of the sound quality.

In No. 16, simulation was so performed that each of the four sound sources was reduced to an intermediate value of levels at which the sound would not be heard. This is just one example, and it is possible to freely set how low each level of the four sound sources should be lowered and which combination of these lowered sound sources should be made. Therefore, it is possible to perform a simulation on achievement of the target value by finding out which of the sound sources should be selected and how low the sound source should be lowered. Accordingly, an adequate plan can be found out considering an effect due to improved sound quality, a technological difficulty level, and a cost for the improvement.

In order to loosen discomfort, the four sound sources have been improved as follows.

(I) Paper-sliding Sound

Figure 9:
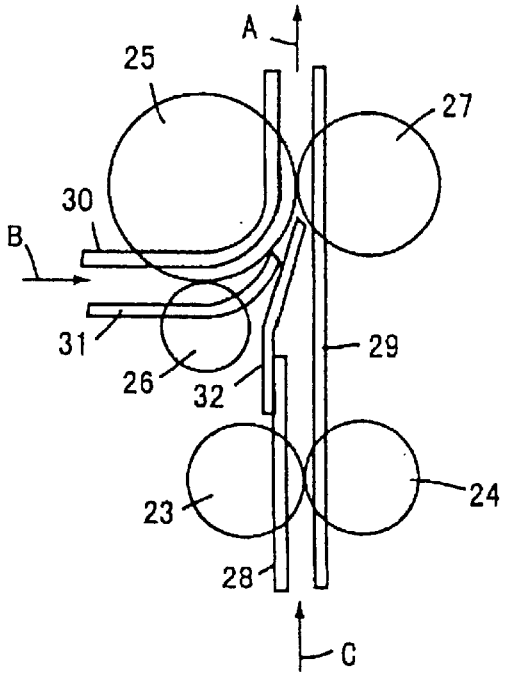
FIG. 9 is a schematic diagram showing a structure of paper conveying section used in the image formation apparatus.

FIG. 9 is a cross-sectional view of a conveying part that guides both of paper conveyed from the paper feed tray and paper conveyed from the intermediate tray for two-sided copying in the direction of the resist rollers.

Figure 10:
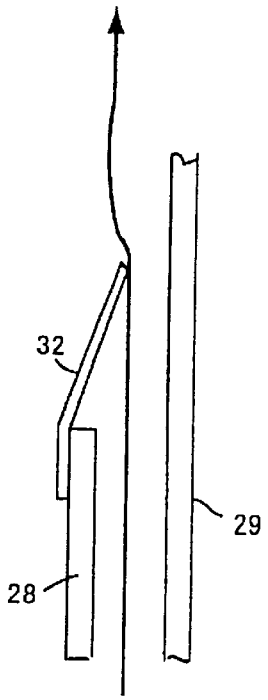
FIG. 10 is a schematic diagram showing a structure of paper conveying section used in the conventional image formation apparatus.

FIG. 10 shows a conventional relation between a paper and a flexible sheet 32.

In FIG. 9, the legends 23 and 24 represent rollers each of which has a plurality of rollers passed through with its shaft. These roller 23 and roller 24 are formed as a first conveying roller pair that conveys paper, and rotate so as to convey the paper fed from the paper feed tray, not shown, in the direction indicated by the arrow A in FIG. 9. The legends 25, 26, and 27 in FIG. 9 represent rollers each of which has a plurality of rollers passed through with its shaft. These roller 25 and roller 26 are formed as a second conveying roller pair that conveys paper, and rotate so as to convey the paper fed from the intermediate tray, not shown, in the direction indicated by the arrow B in FIG. 9.

The roller 25 and the roller 27 are formed as a third conveying roller pair that conveys paper, and rotate so as to convey the paper in the direction indicated by the arrow C in FIG. 10, that is, in the direction of the resist rollers.

Guide plates 28 and 29 are provided along the conveying path of the first conveying roller pair that rotates so as to convey paper in the direction indicated by the arrow A. These guide plates 28 and 29 have holes so as to escape from the roller parts of the rollers 23 and 24. Likewise, guide plates 30 and 31 are provided along the conveying path of the second conveying roller pair that rotates so as to convey paper in the direction indicated by the arrow B. These guide plates 30 and 31 have holes so as to escape from the roller parts of the rollers 25 and 26.

Extending parts of the guide plates 29 and 30 are provided along the conveying path of the third conveying roller pair that rotates so as to convey paper in the direction indicated by the arrow C. These parts have holes so as to escape from the roller parts of the rollers 25 and 27.

The flexible sheet 32 extending in the paper conveying direction is fixed to the edge part of the guide plate 28 on its downstream side, along which the paper is guided. The conveying paths are formed so that both the paper conveyed from the direction A and the paper conveyed from the direction B are conveyed in the direction C.

The paper conveyed from the intermediate tray 20 in the direction B has, in many cases, a downward curl. Therefore, the flexible sheet (more specifically, the mylar sheet) 32 is bent rightward in FIG. 10 in order to prevent buckling and jamming. Accordingly, the paper conveyed from the paper feed tray to the direction A proceeds around the front end of the flexible sheet 32 into between the conveying roller pair 25 and 27. Therefore, as shown in FIG. 9, the paper is conveyed while sliding along the front end of the flexible sheet 32. The surface of the paper is uneven due to its fibers. On the other hand, the flexible sheet 32 has been sheared, so that burrs are left around the sheet. It takes a high cost and a plenty of time to remove the burrs from the flexible sheet 32 one by one. As the unevenness of the fibers on the paper surface is developing, the burrs at the edge of the flexible sheet 32 and the paper vibrate to produce a loud sound, which becomes noise.

The embodiment of this invention takes measures against occurrence of vibrations as explained below.

Figure 11A:
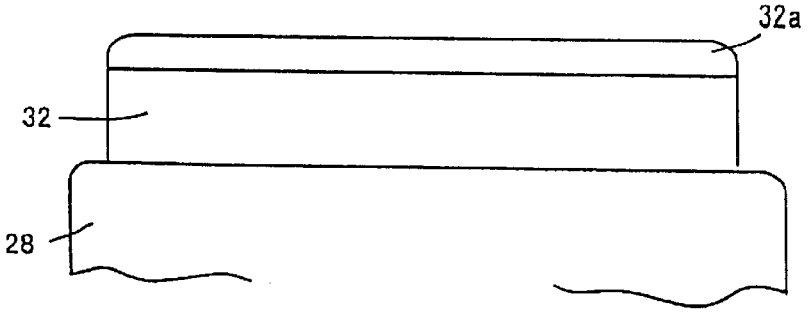
FIGS. 11A and 11B show the paper conveying section used in the image formation apparatus of FIG. 1.
Figure 11B:
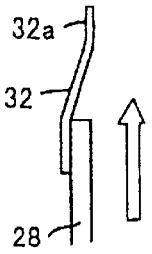
Figure 12:
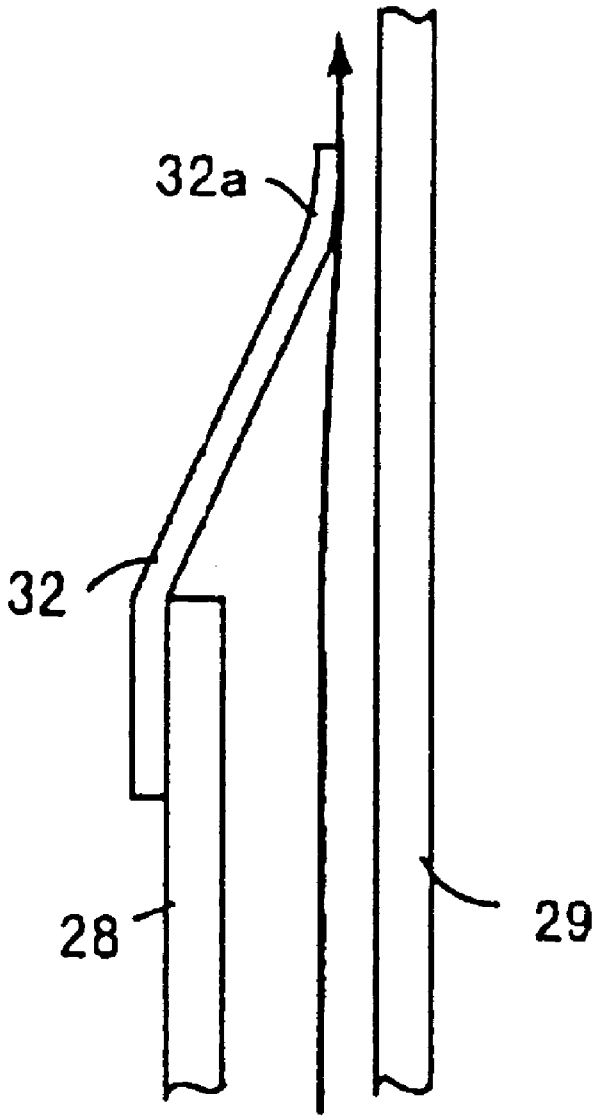
FIG. 12 is a schematic diagram showing how to convey a paper in the paper conveying section shown in FIG. 11.

Examples of the flexible sheet 32 according to the example of this invention are shown in FIGS. 11A, 11B, and FIG. 12.

In FIGS. 11A, 11B, and FIG. 12, the front end of the flexible sheet 32 fixed to the guide plate 28 has a bending part 32*a* formed in order to reduce a sliding sound produced when the front edge is sliding along paper conveyed from the direction indicated by the arrow A in FIG. 10 as if it scratches the paper (the paper surface has a certain degree of surface roughness, therefore, a loud sound is produced by sliding the edge along the surface). The surface of the flexible sheet 32 is quite smooth, so that provision of the bending part 32*a* does not affect its smoothness.

FIG. 12 shows how the paper is conveyed while sliding along the bending part 32*a* of the flexible sheet 32.

Figure 13:
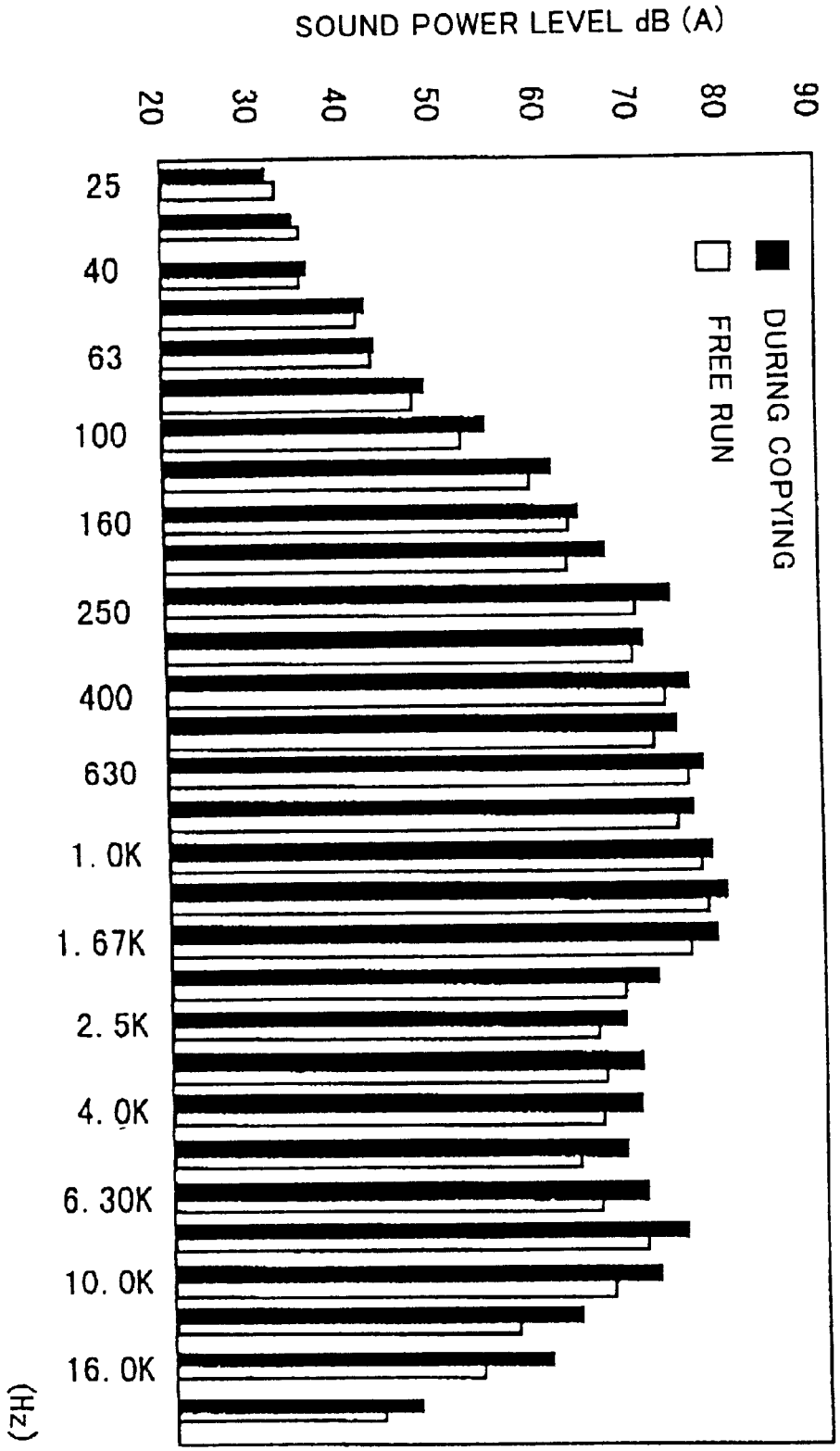
FIG. 13 shows results of analysis of frequencies during paper passing and during not paper passing.

FIG. 13 shows an example of comparison concerning frequency analysis (⅓ octave band analysis) of noise of the image formation apparatus. The comparison was made between the time of passing paper for copying and the time of free run (mode in which copying is operated without paper being passed).

Figure 14:
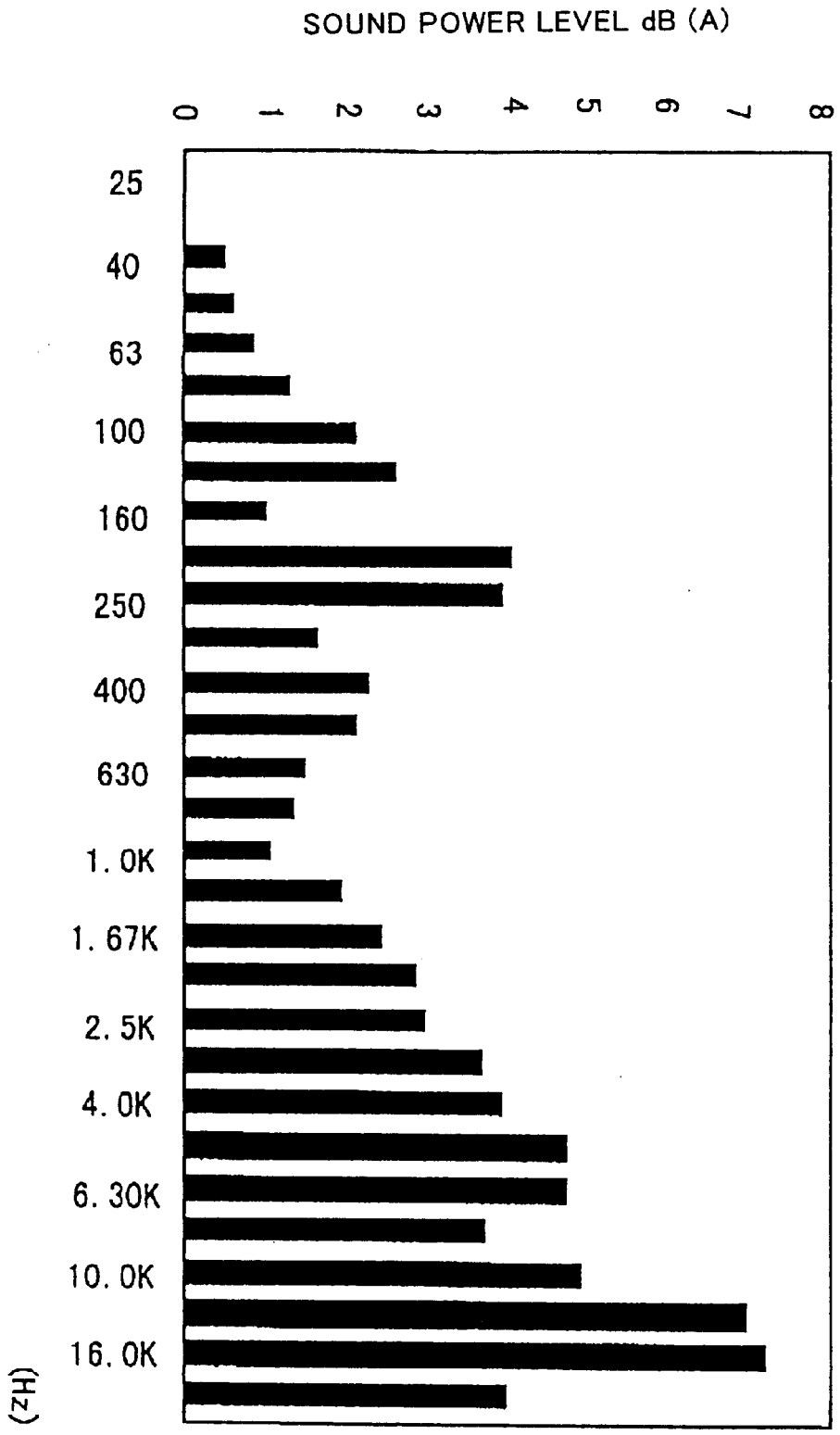
FIG. 14 shows results of analysis of frequencies during copying and during not copying (not paper passing)

FIG. 14 is a graph of differences between sound power levels on copying and on free running. Since the main object of this graph is to study a distribution of frequencies, relative comparison between the sound power levels of frequency bands is significant, but absolute values of the sound power levels are not significant because accurate proofreading was not performed.

The difference between the sound power levels for each frequency bandwidth in FIG. 14 occurs depending on whether paper is passed or not. That is, this figure is a frequency distribution of sounds derived from conveyance of paper.

According to FIG. 14, a difference of 3 (dB) or more can be seen in a band with center frequencies of 200 to 250 Hz of comparatively low frequencies and in a band of not less than 3.15 kHz as comparatively high frequencies. Acoustically, the difference of 3 (dB) means that a difference in the sound energy between the copying and free running becomes twice.

As a result of the analysis, it is understood that the sound in the band with center frequencies of 200 to 250 Hz of comparatively low frequencies is an impulsive sound produced between the paper and the conveying rollers. This sound has been understood, according to the experiment on evaluation of sound quality, that there is no relation with discomfort. Therefore, any measures for improvement in sound quality do not need to be taken. Further, the frequencies of 3.15 kHz or more were found a sliding sound due to paper. That is, this sound is produced when the paper vibrates because the paper and the front edge of the flexible sheet 32 rub against each other.

As shown in FIG. 14, the band with center frequencies of 12.5 k to 16 kHz has a remarkable difference as high as about 7 (dB).

By forming the flexible sheet 32 as shown in FIG. 11 and FIG. 12, the sound source of the paper-sliding sound can be dealt with fundamentally, and the frequencies of 3.15 kHz or more can be reduced. This frequency band largely contributes to sharpness and contributes to loudness as well.

(II) Metal-impulsive Sound

Figure 15:
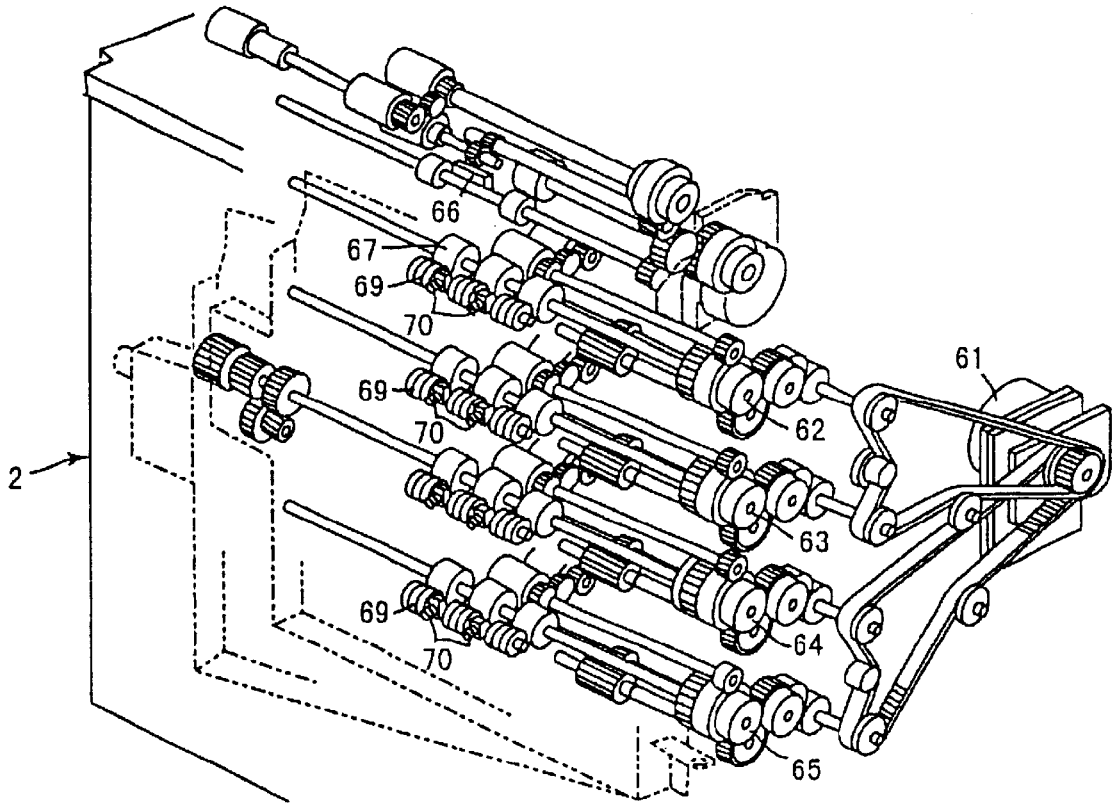
FIG. 15 is a perspective view showing a structure of a drive transmitting system in the paper conveying section of a paper feeding bank.

FIG. 15 shows a situation of the drive transmitting mechanism of the paper feeding bank 5 in the lower housing 2 and the paper conveying rollers in a perspective view.

The paper feeding bank 5 is capable of feeding paper in four stages, the top stage of which has the shortest conveying path, therefore, image formation of a first paper is performed the quickest. Accordingly, A4 size paper used the most frequently is set in the first stage (the uppermost stage), and B4 and A3 size paper, not frequently used recently, are often set in the third and fourth stages (lower stages).

Grip rollers 67 are provided in each paper feeder in the four stages, and paper fed from any paper feeder moves upward through the grip rollers 67. A driven roller 69 is provided in each grip roller 67, and is pressurized by a pressurizing spring 70. These grip rollers 67 and paper separating mechanisms (not shown) are driven by a bank motor 61 to convey paper to the upper housing 1.

The shafts of the grip rollers 67 have an intermediate clutch (hereinafter called an intermediate CL: the first clutch) 62, an intermediate CL (second) 63, an intermediate CL (third) 64, and an intermediate CL (fourth) 65 provided in order from the upper shaft. These clutches are electromagnetic clutches, each of which is driven or cut off by turning a current ON or OFF. This is because efficiency of image formation is increased by feeding a paper during image formation to leave less space between papers. A relay sensor 66 is provided as a trigger for image writing and a jam detector.

The main factor of the metal-impulsive sound has been found the intermediate CLs 62 to 65 in the paper feeding bank 5.

These four intermediate CLs operate each time a sheet of paper is fed, and operate even if a paper is fed from any of the stages in the paper feeding bank 5 in order to make their control easier. Therefore, even if the paper is fed from the first stage of the bank, the second to fourth grip rollers 67 of the bank are also driven, although they do not need to be driven. When the paper is fed from the fourth stage of the bank (the lowermost), all the intermediate CLs 62 to 65 need to be operated because the paper does not move upward unless all the grip rollers 67 operate. However, as explained above, the most frequently used stage is the first stage or as far as the second stage of the bank.

The third and fourth stages are used less frequently because paper of less frequently used size is set in these stages.

A metal-impulsive sound is produced loudly when the intermediate CLs 62 to 65 of the paper feeding bank 5 simultaneously operate. Therefore, by operating only the intermediate CL 62 when the first stage of the bank is used, production of energy of the metal-impulsive sound can be suppressed to one fourth. By controlling so as to operate only the intermediate CL(s) in the upper stage(s) from the bank used for feeding a paper, both noise and electric energy can be suppressed as well.

Figure 16:
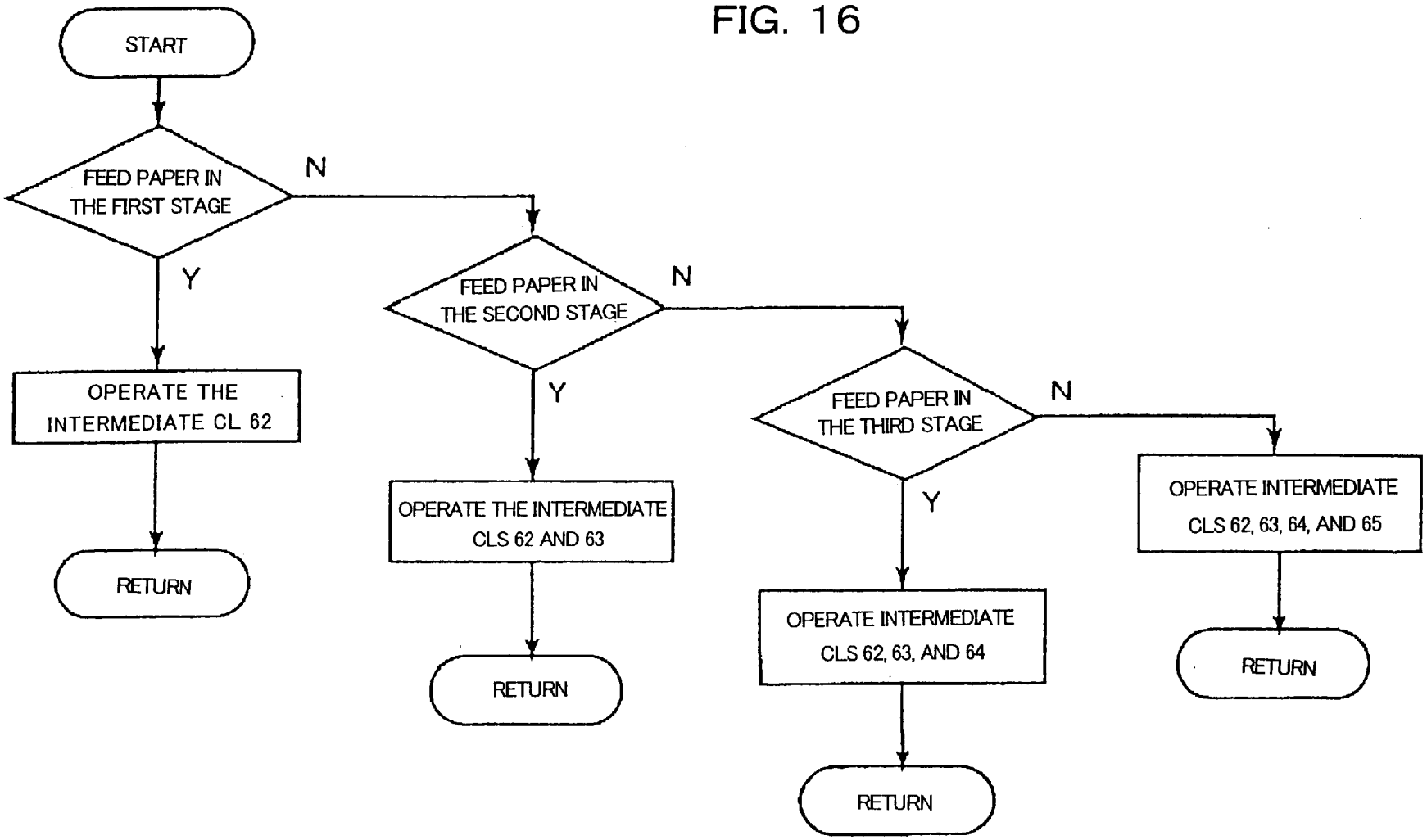
FIG. 16 is a flow chart showing operation of an intermediate clutch used for the paper feeding bank.

FIG. 16 is an example of a flow for controlling the intermediate CLs 62 to 65. The flow shows only the control part of the intermediate CL.

Figure 28:
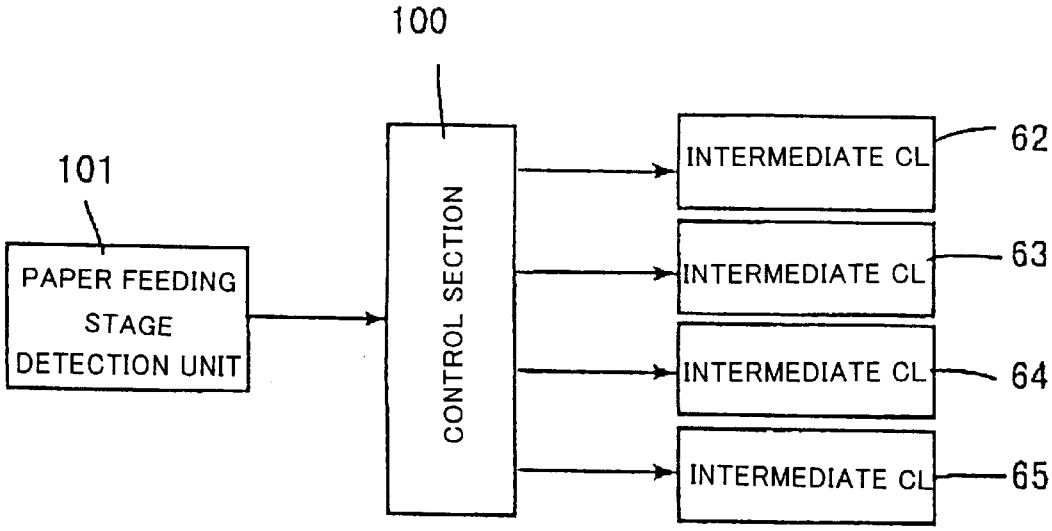
FIG. 28 is a block diagram showing a structure of a control section for executing the flow chart shown in FIG. 16.

In each of the intermediate CLs 62 to 65, a stage to be operated can be set by the control section 100 shown in FIG. 28. This control section 100 of FIG. 28 uses a control section for managing the whole image processing. In FIG. 28, the control section 100 has a key section configured by a microcomputer, a paper feeding stage detection unit 101 is connected to its input side through an I/O interface, not shown, and the intermediate CLs 62 to 65 are connected to its output side. When the detection unit 101 detects that any stage of paper feeder cassettes 14 in the paper feeding bank 5 has been specified, the control section 100 selects an intermediate CL corresponding to the stage to be driven.

The intermediate CL(s) as only the required one(s) is operated under the control of the control section 100, and the intermediate CL(s) in the lower stage(s), that is used less frequently, is not operated. Thus, occurrence of the metal-impulsive sound can be suppressed.

Figure 17:
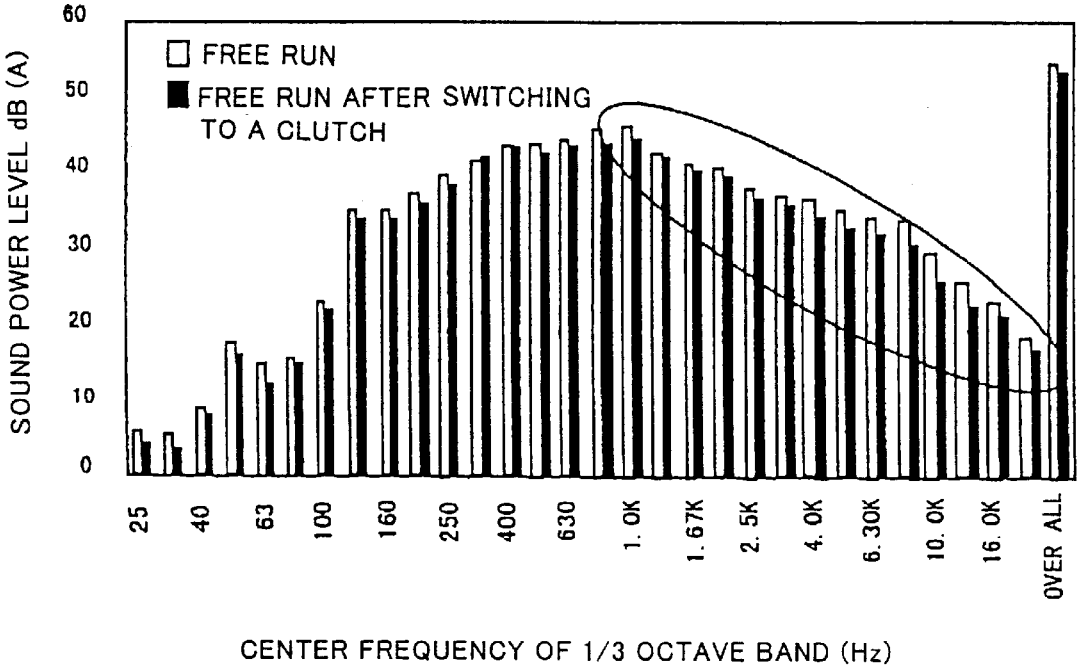
FIG. 17 shows fluctuations in noise before and after switching control of the intermediate clutches during not paper passing.

FIG. 17 is a graph showing fluctuations in noise before and after switching control of the intermediate Cls during free run (mode in which image formation is operated without paper passed). "Free run" in the graph represents the operation of the four intermediate CLs 62 to 65 in the conventional manner. "Free run after switching to a clutch" represents the operation of only the first intermediate CL 62.

According to this graph, the impulsive sound of the clutch is a broadband noise on the side of high frequencies of about 1 k to 20 kHz. Thus, this sound contributes to sharpness and loudness. As explained above, by suppressing the sound source of the impulsive sound, the uncomfortable sound was reduced.

(III) Sound of the Paper Feeding Bank Motor Drive System

Figure 18:
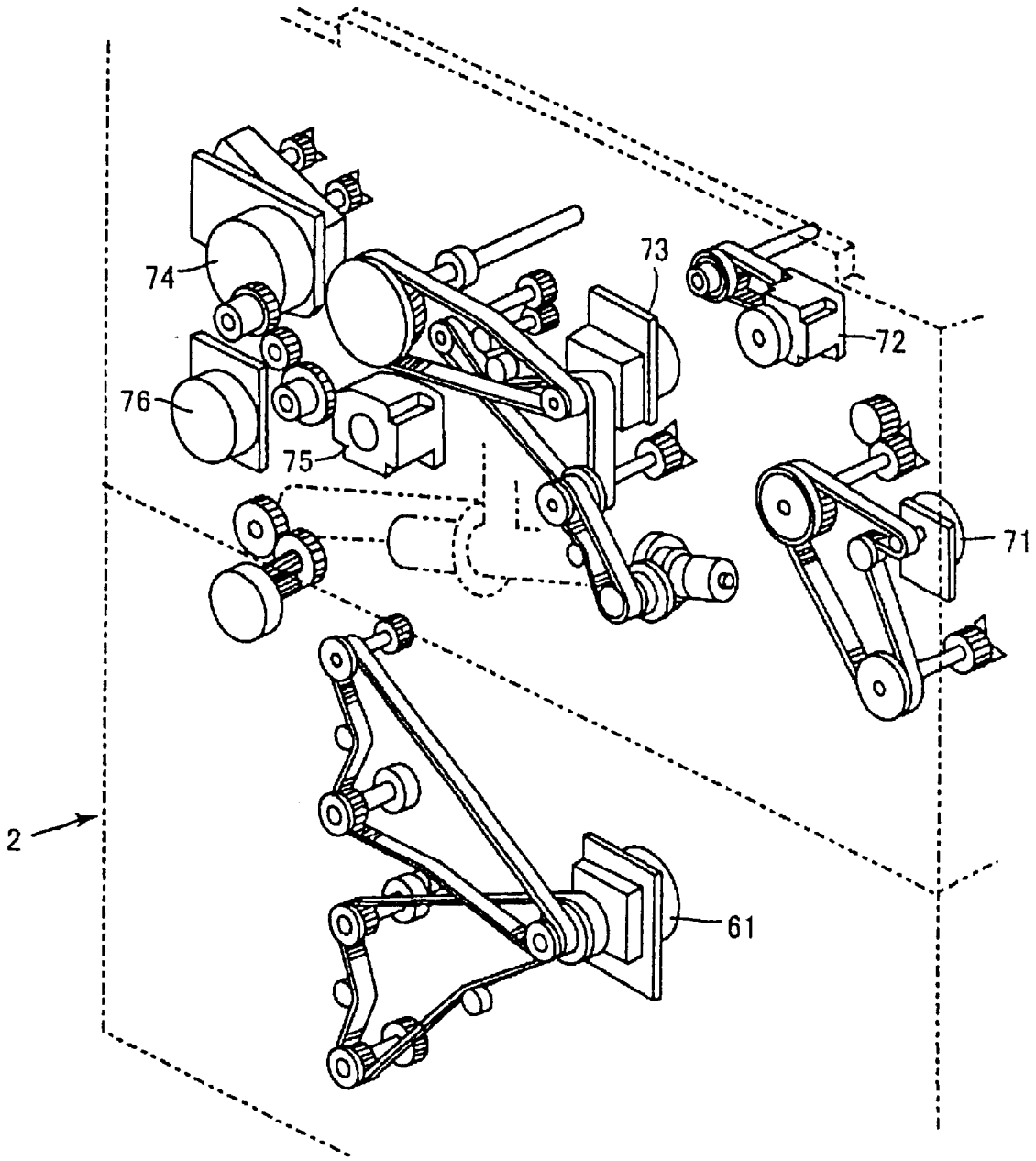
FIG. 18 is a perspective view showing a structure of the drive system in the paper feeding bank.

FIG. 18 is a layout of the model A's drive system. The driving motor comprises the bank motor 61, two-sided fixing motor 71, scanner motor 72, drum main motor 73, developing motor 74, resist motor 75, and the manual feeder motor 76. The developing motor 74, bank motor 61, and the drum main motor 73 have been dominant as sounds of the drive system. With regard to the other motors, their sound impression after being turned off did not changed so much. The drum main motor 73 has been recognized as a specific sound source during image formation, but enhancement or attenuation of the sound hardly affected its uncomfortable feeling.

Figure 19:
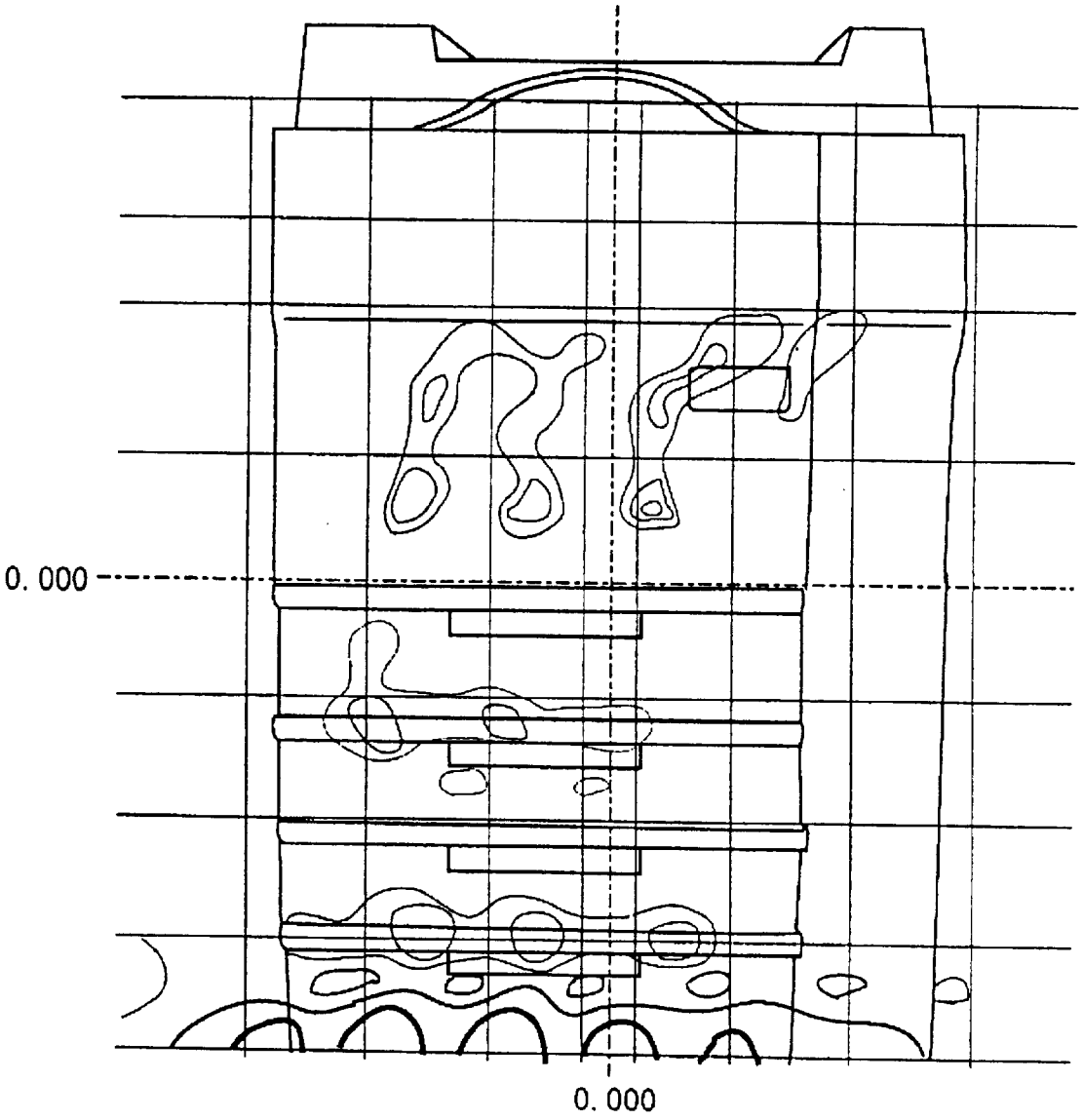
FIG. 19 shows results of measuring sounds by near-field acoustical holography at a front surface as one of exterior surfaces of the image formation apparatus.

FIG. 19 shows a result of measuring the front surface of the model A by near-field acoustical holography (NAH) The NAH visualizes a sound. According to this NAH, radiation of a strong sound from the lower side of the bank can be seen (in FIG. 9, the radiation part of a strong sound is indicated by a heavier line than lines used for the other radiation parts). The frequency characteristics of this part coincide with the frequency of the sound of the bank motor drive system, and based on this fact, it is found that the sound of the bank drive system leaked from the lower part of the bank.

Figure 20:
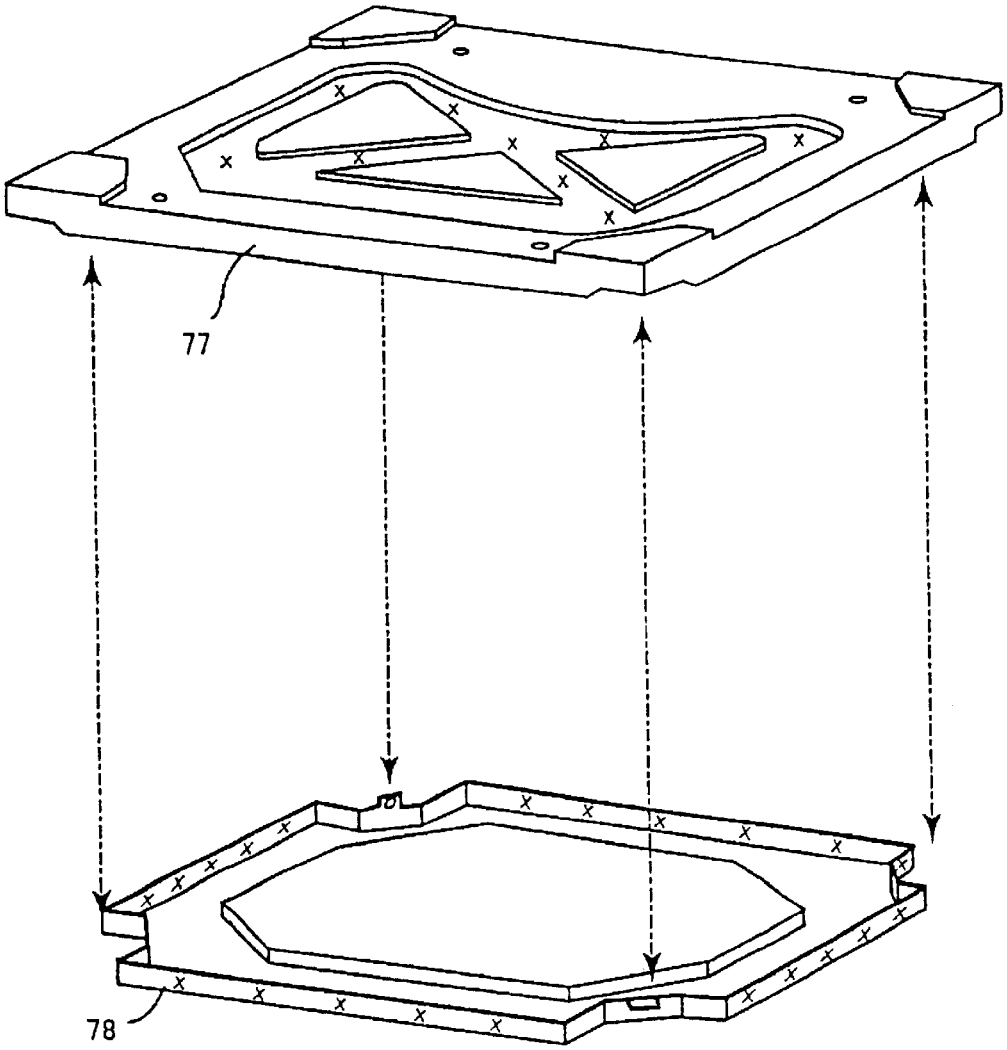
FIG. 20 is an exploded perspective view showing a bottom plate of the paper feeding bank for the image formation apparatus shown in FIG. 1.

FIG. 20 is the exploded perspective view showing a bottom plate of the paper feeding bank.

The upper and lower metal sheets 77 and 78 were drawn in order to enhance their strength, and put together like a lunchbox to be welded.

Figure 21:
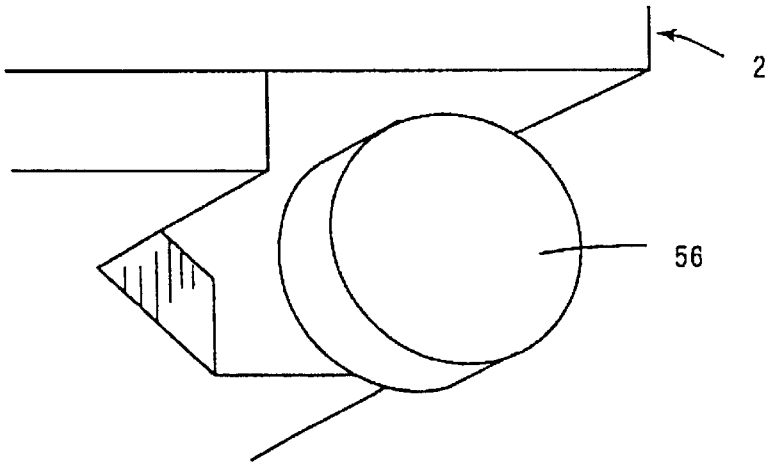
FIG. 21 is a partially perspective view showing the bottom part of the paper feeding bank when viewed from its underside.

FIG. 21 is a view showing the bottom part of the paper feeding bank when viewed from its lower side. The bank bottom has casters 56 at its four corners. When the upper and lower metal sheets 77 and 78 are put together, openings are disadvantageously formed.

Figure 22:
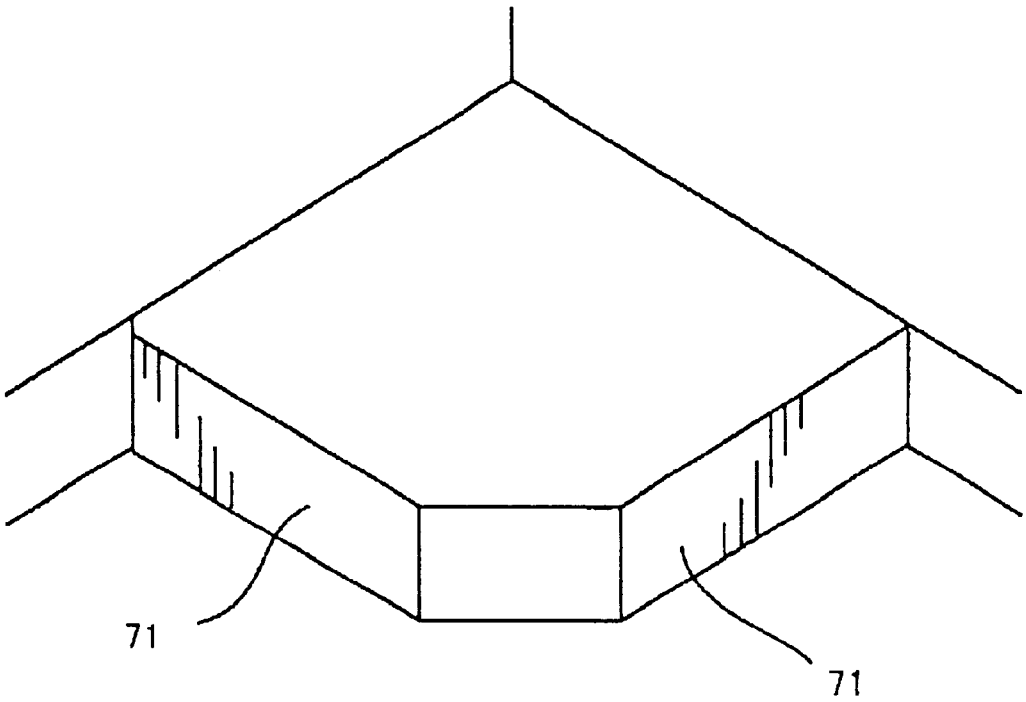
FIG. 22 is a perspective view showing the bottom part of the paper feeding bank shown in FIG. 21 when viewed from its upper side.

FIG. 22 is a view of the bottom part when viewed from a slanting direction in FIG. 21.

In order to prevent leakage of the sound from the bottom of the bank, the openings were blocked with shielding plates 71. The shielding plate may be a soundproofing metal plate. Alternatively, the upper and lower metal sheets 77 and 78 may be so structured that the openings will not be formed when they are put together.

As for the bank 5, the measures were taken not against its sound sources but against the transmission path of the noise from the sound sources. The sounds are insulated by not taking any measures against the sound sources such as the bank motor, joints of gears, or the timing belt but by preventing leakage of air-borne sounds from the sound sources.

(IV) Sound of the Developing Motor Drive System

Figure 23:
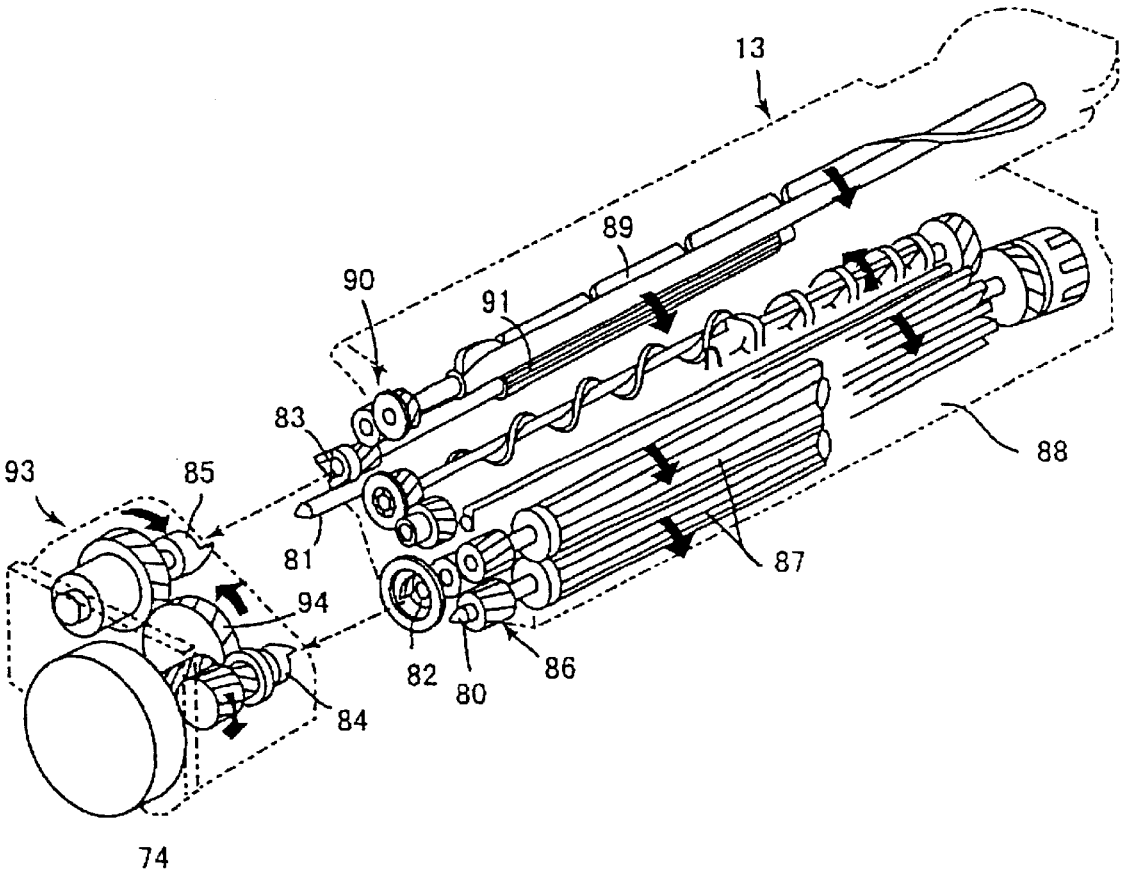
FIG. 23 is a perspective view showing a correlation between a developing unit in the developing section and its driving unit.

FIG. 23 shows a relation between the developing unit 13 and the developing motor unit 93.

The developing motor unit 93 comprises the developing motor 74, gear array 94, and the joints 84 and 85. This developing motor unit 93 is disposed at an accurate position on a side plate (not shown) of the main body of the upper housing 1, and secured.

The developing unit 13 is removable from the image formation apparatus for its maintenance.

In order to convey a driving force from the developing motor unit 93 to the developing unit 13, the joints 84 and 85 of the motor are engaged with the joints 82 and 83 of the developing unit 13, respectively. In an actual case, the claws within the joints are engaged with each other to convey a driving force. The driving force conveyed from the joint 82 rotates developing members such as a two-stage developing sleeve 87 and an agitating roller 88 in the direction indicated by the arrow through a gear array 86. Further, the driving force conveyed from the joint 83 rotates, in addition to the developing members, developing members such as an agitator 89 and a toner supply roller 91 in the direction indicated by the arrow through a gear array 90.

The position of the developing unit can accurately be secured by inserting reference pins 80 and 81 into reference holes (not shown) on the side plate of the main body.

Figure 24:
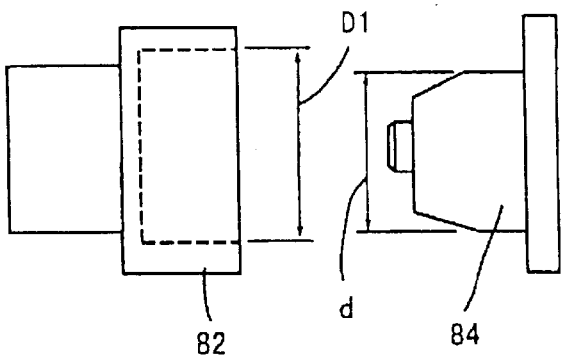
FIG. 24 shows an example of a structure of an engagement section used for positioning of the units shown in FIG. 23.

FIG. 24 is a view of only the joints 82 and 84 extracted from the structure.

The diameter D1 of the joint 82 on the motor side is made slightly larger than the diameter d of the joint 84 on the developing unit side. This is because the developing unit 13 is easily inserted.

The shaft centers of the joints 82 and 84 coincide with each other in terms of design. However, since positioning of the developing unit 13 is carried out with the reference pins 80 and 81, the shaft centers may be displaced due to bottom-up of component tolerances. Even if they are slightly displaced, there is no problem in conveyance of a driving force by engaging the claws of the joints 82 and 84 with each other. However, if the driving force is conveyed while the shaft centers remain displaced, the overall developing unit vibrates, and a frequency of one rotational cycle of the joint 82 is synthesized to the frequency of a sound derived from engagement of the gears of the developing unit to produce a sound like whine. Accordingly, as compared to the case where the shaft centers accurately coincide with each other and are joined to each other, the noise becomes higher, which makes feel uncomfortable.

Figure 25:
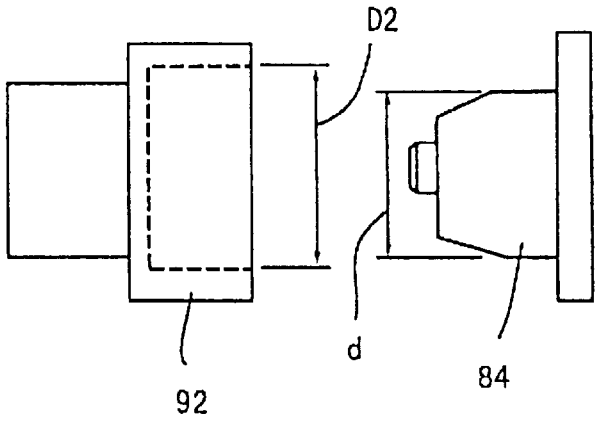
FIG. 25 shows a structure of an engagement section used for positioning of the developing unit and its driving unit according to the embodiment of this invention.

FIG. 25 shows improvement against displacement of the shaft centers. In this case, a method of fixing the developing motor unit 93 and the developing unit 13 is different.

The developing unit 13 is positioned with the dowel pins 80 and 81 to be fixed. The inner diameter D2 of the joint 92 and the outer diameter d of the joint 84 are engaged with each other, and the developing motor unit 93 is screwed on the side plate of the main body. The inner diameter D2 of the engaging part of the joint 92 and the outer diameter d of the engaging part of the joint 84 have engagement tolerances and concentricity such that the shaft centers of both shafts coincide with each other at the time of their engagement.

In the example, the structure of the positioning and engagement is employed, but the method is not limited to the above-mentioned method if it is a method capable of making shaft centers coincide with each other to be joined. For example, the driving force from the developing motor unit 93 may be received by the gear with the dowel pin 80 of the developing unit 13. That is, the shaft centers for conveying a driving force are displaced because the positioning reference pin of the developing unit 13 and the reference with respect to conveyance of a driving force are not on the same line. Therefore, by making references with respect to positioning and conveyance of the driving force coincide with each other, the driving force can smoothly be conveyed, and a position of the unit can easily be specified. In short, by making the reference with respect to positioning for conveyance of a driving force between the development driving unit and the developing members coincide with the reference with respect to positioning for mounting of the two, the positioning can be carried out under the same condition, which is different from the positioning based on different references, thus eliminating displacement of the shaft centers. Accordingly, by suppressing vibrations of the vibrating source (sound source) of the developing unit 13, the uncomfortable sound can be reduced.

Figure 26:
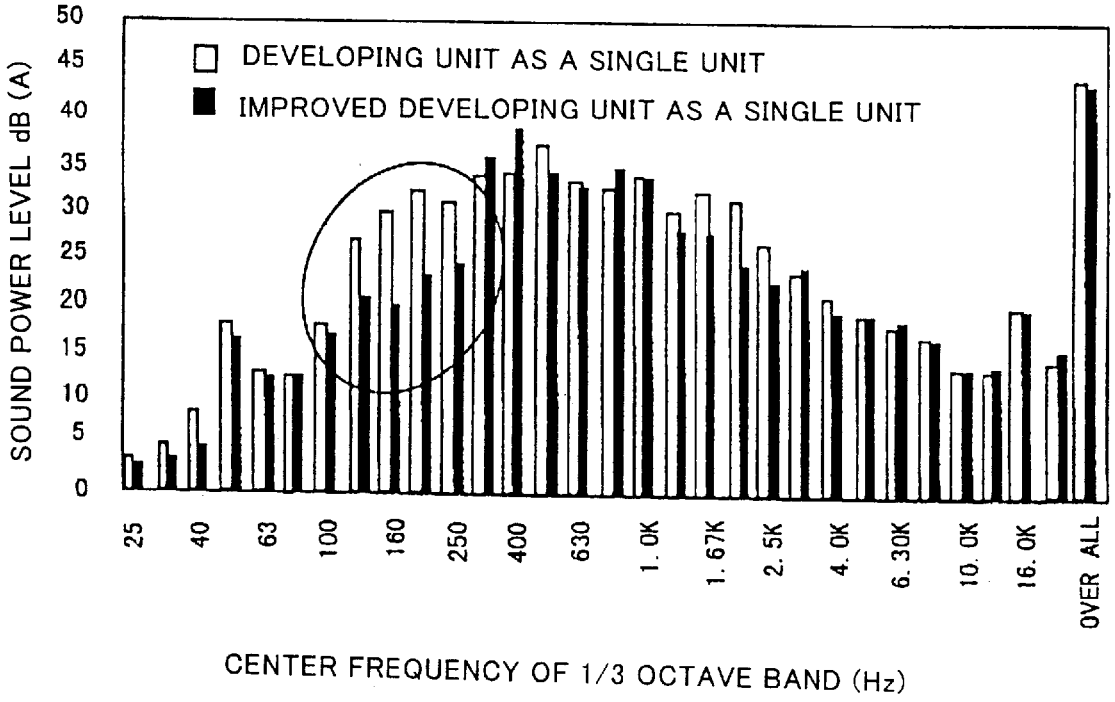
FIG. 26 shows results of comparison between noises based on the positioning structures shown in FIG. 24 and FIG. 25.

FIG. 26 shows comparison between noises before and after taking any measures against the noise when the developing unit 13 is driven by the developing motor unit 93. This case is not a case of image formation but a case where the developing motor unit 93 is discretely driven.

As shown in FIG. 26, a remarkable effect due to improvement was obtained in the frequency band of 125 to 250 Hz.

Figure 27:
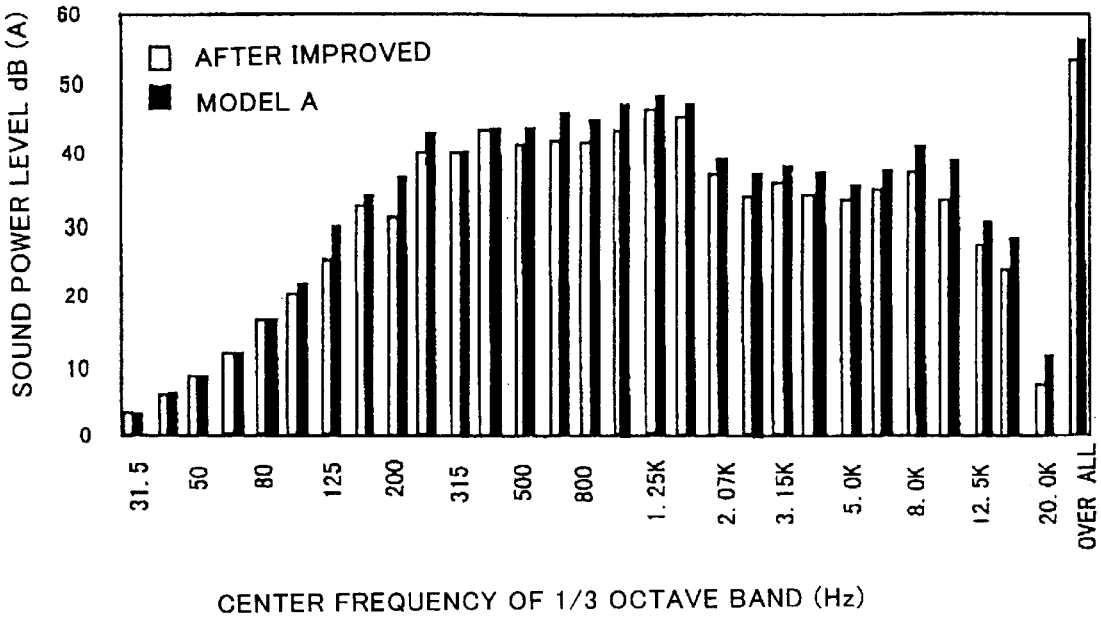
FIG. 27 shows results of comparison between noises in the apparatus with sound quality improved and the apparatus with no such improvement applied.

FIG. 27 shows comparison between noises in the model A and the machine a where all the four improvements have been applied. As shown in the figure, the improvement can be seen in almost all of the frequency bands. Table 5 shows comparison between the machine a and the model A by measuring the loudness and the sharpness at this time and calculating each discomfort index S.

TABLE 5

| | LOUDNESS (sone) | LOUDNESS 2 | SHARPNESS (acum) | DISCOMFORT INDEX S |
|---|---|---|---|---|
| MODEL A | 10.44 | 109.0 | 2.41 | −0.275 |
| MACHINE AFTER IMPROVEMENT OF THIS INVENTION IS APPLIED | 8.65 | 74.8 | 2.10 | −0.721 |

According to this result, of the situations: by satisfying S<−0.3555 . . . condition (b), the uncomfortable feeling is loosened, and by satisfying S<−0.6296 . . . condition (c), discomfort is hardly felt, the machine corresponds to the situation indicated by (c), which makes it possible to hardly feel uncomfortable.

According to one aspect of this invention, by setting the discomfort index S so as to become a specified value, it is possible to obtain a state where the uncomfortable feeling for noise is loosened or there is almost no uncomfortable feeling.

According to another aspect of this invention, occurrence of the noise in the members affected to the paper-sliding sound as a noise source during paper conveyance can be suppressed. Thus, it is possible to loosen the uncomfortable feeling due to the noise during paper conveyance. Particularly, in this invention, by using a flexible sheet for the member in direct contact with paper, a rubbing sound with the paper can be reduced.

Further, by reducing the metal-impulsive sound, it is possible to loosen the uncomfortable feeling due to the noise from the noise source.

Further, by reducing the sound of bank motor drive system as the paper feeding unit, it is possible to loosen the uncomfortable feeling due to the noise. Particularly, in this invention, the air-borne sound as one of targets for reduction is also reduced. Thus, it is possible to more effectively loosen the uncomfortable feeling due to the noise.

Further, by reducing the sound of the developing unit, particularly, the sound of the developing motor drive system, it is possible to loosen the uncomfortable feeling due to the noise.

Further, noise is loosened by selectively combining noises from the sound sources and using either one of or both of units for suppressing noise of a noise source itself and of its transmission path. Thus, it is possible to loosen the uncomfortable feeling due to the noise by using one of the most effective units in terms of the effect of improvement in reduction of the uncomfortable sound source, technological difficulty level, and the cost.

The present document incorporates by reference the entire contents of Japanese priority documents, 2000-315003 filed in Japan on Oct. 16, 2000 and 2001-289084 filed in Japan on Sep. 21, 2001.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A method of improving the quality of sounds produced from a device provided with a mechanical drive mechanism and the like, wherein, by using either one of or both of units for suppressing noise of a noise source produced in said device and of its transmission path, a discomfort index S of a sound obtained by inputting a value of loudness and a value of sharpness of psychological sound parameters obtained from a sound at a position apart by 1 meter from the exterior of said device into the following equation (a):

$$S=0.01024269\times(\text{loudness value})^2+0.30996744\times(\text{sharpness value})-2.1386517 \quad (a)$$

will satisfy the following condition (b):

$$S<-0.3555. \quad (b)$$

2. The method of improving sound quality according to claim 1, wherein the obtained discomfort index S further satisfies the following condition (c):

$$S<-0.6296. \quad (c)$$

3. An image formation apparatus to which the sound quality improving method according to claim 1 is applied, wherein said mechanical drive mechanism includes a paper conveying unit and a drive transmitting unit, and a sound produced from said paper conveying unit is reduced to satisfy the condition (b) or (c).

4. The image formation apparatus according to claim 3 using a unit that reduces a sliding sound produced between paper and a guide member for said paper as a sound produced from said paper conveying unit.

5. The image formation apparatus according to claim 3, wherein said paper conveying unit has a guiding unit for paper, which is formed with a flexible sheet, and an edge part of its surface contacting said paper is bent.

6. The image formation apparatus according to claim 3, wherein an impulsive sound produced by metal is reduced to satisfy the condition (b) or (c).

7. The image formation apparatus according to claim 6 further comprising paper conveying units in a plurality of stages which become a source of producing the metal-impulsive sound, wherein said paper conveying units have electromagnetic clutches for the number of stages, and only an electromagnetic clutch of the paper conveying unit in a state of being ready to convey paper is operated.

8. The image formation apparatus according to claim 3, wherein a sound produced from a drive system of said paper conveying unit is reduced to satisfy the condition (b) or (c).

9. The image formation apparatus according to claim 8, wherein air-borne sound is insulated from the drive system.

10. The image formation apparatus according to claim 3, wherein said mechanical drive mechanism has a developing unit, and a sound from said developing unit is reduced to satisfy the condition (b) or (c).

11. The image formation apparatus according to claim 10, wherein said develop ing unit has a developing member and a developing member driving unit that drives said developing member, said developing member driving unit has a drive transmitting unit for transmitting a driving force to said developing member, and a reference with respect to positioning for transmitting a driving force between said developing member driving unit and the developing member and a reference with respect to positioning for mounting both of said unit and member are made coincide with each other.

12. The image formation apparatus according to claim 3 which satisfies the condition (b) or (c) by using either one of or both of a unit, that absorbs noise from a noise source itself to suppress the noise by selectively combining noises produced from a sound source inside said apparatus, and a suppressing unit disposed on the transmission path of the noise.

13. The image formation apparatus according to claim 3, wherein said loudness value and sharpness value are obtained by collecting sounds produced from said image formation apparatus with a sound measuring device HSMIII manufactured by Head Acoustics and analyzing the sounds with a Binaural Analysis System BAS manufactured by Head Acoustics, and the discomfort index S satisfies the condition (b):

$$S<-0.3555 \quad (b)$$

or the condition (c):

$$S<-0.6296. \quad (c)$$

* * * * *